US005610547A

United States Patent [19]

Koyama et al.

[11] Patent Number: 5,610,547

[45] Date of Patent: *Mar. 11, 1997

[54] LOGARITHMIC TRANSFORMATION CIRCUITRY FOR USE IN SEMICONDUCTOR INTEGRATED CIRCUIT DEVICES

[75] Inventors: Mikio Koyama, Kawasaki; Tadashi Arai, Tokyo, both of Japan

[73] Assignee: Kabushiki Kaisha Toshiba, Kawasaki, Japan

[ * ] Notice: The term of this patent shall not extend beyond the expiration date of Pat. No. 5,465,070.

[21] Appl. No.: 472,483

[22] Filed: Jun. 7, 1995

Related U.S. Application Data

[63] Continuation of Ser. No. 986,043, Dec. 4, 1992, Pat. No. 5,465,070.

[30] Foreign Application Priority Data

| | | | |
|---|---|---|---|
| Dec. 5, 1991 | [JP] | Japan | 3-321873 |
| Jul. 21, 1992 | [JP] | Japan | 4-194001 |
| Jul. 31, 1992 | [JP] | Japan | 4-205486 |

[51] Int. Cl.[6] ..... G06G 7/12

[52] U.S. Cl. ..... 327/350; 327/103; 327/560; 327/65; 330/260; 330/252

[58] Field of Search ..... 327/350, 351, 327/103, 100, 560, 563, 65, 63, 52, 355; 330/260, 252

[56] References Cited

U.S. PATENT DOCUMENTS

| | | | |
|---|---|---|---|
| 4,072,820 | 2/1978 | Davis | 322/65 |
| 4,631,745 | 12/1986 | Marik | 322/350 |
| 4,675,594 | 6/1982 | Reinke | 322/103 |
| 5,157,350 | 10/1992 | Rubens | 330/254 |

*Primary Examiner*—Timothy P. Callahan
*Assistant Examiner*—Dinh T. Le
*Attorney, Agent, or Firm*—Oblon, Spivak, McClelland, Maier & Neustadt, P.C.

[57] ABSTRACT

A gain cell circuit includes a logarithmic transformation circuit. The logarithmic transformation circuit includes a pair of first and second transistors, each of which has first and second current carrying electrodes and a control electrode. The control electrodes of the first and second transistors are coupled to input terminals of the logarithmic transformation circuit. The logarithmic transformation circuit further includes third and fourth transistors coupled to the first and second transistors. The third and fourth transistors have control electrodes serving as output terminals of the logarithmic transformation circuit, first current carrying electrodes connected at first and second circuit nodes to the second current carrying electrodes of the first and second transistors, and second current carrying electrodes coupled to a power supply voltage. The logarithmic transformation circuit further includes an impedance element connected between the first and second nodes, and level-shift circuits connected to the second current carrying electrodes of the first and second transistors and to the control electrodes of the third and fourth transistors.

12 Claims, 25 Drawing Sheets

LOGARITHMIC TRANSFORMATION CIRCUITRY FOR USE IN SEMICONDUCTOR INTEGRATED CIRCUIT DEVICES

This is a continuation, of application Ser. No. 07/986,043 filed on Dec. 4, 1992, now U.S. Pat. No. 5,465,070.

BACKGROUND OF THE INVENTION

1. Field of the Invention

The present invention relates generally to electronic circuits and, more particularly, to a semiconductor integrated circuit device including a logarithmic transformation circuit that attains a logarithmic transformation function.

2. Description of the Related Art

Generally, a logarithmic transformation circuit is the electronic circuit which transforms or converts an input signal supplied thereto into an output voltage having a logarithmic relationship therewith, by utilizing the fact that the voltage between the base and emitter electrodes (base-to-emitter voltage) of a bipolar transistor used therein and a collector current are inherently in the logarithmic relation. Such a logarithmic transformation circuit has a wide applicability as a gain-changeable circuit, by being combined with an inverse logarithmic transformation circuit being added to the output stage of it.

A presently available logarithmic transformation circuit suffers from undesirable occurrence of distortion during the logarithmic transformation of an input signal. The distortion takes place due to the fact that the base-to-emitter voltage of bipolar transistors employed in the circuit may vary with a change in the operating conditions (i.e., variation in collector current) of the bipolar transistors. Such a variation in the base-to-emitter voltage may be rephrased as a variation in the conductance of the input-stage bipolar transistors themselves. Conventionally, to make the influence of the base-to-emitter voltage variation small or "invisible" as much as possible, an increased current is forced to flow in the input-stage bipolar transistors. The forcible supplement of such increased current leads to an increase in the power consumption of a semiconductor integrated circuit device including therein the logarithmic transformation circuit. This may raise serious disadvantages, especially in the case wherein the logarithmic transformation circuit is packed into a highly integrated solid-state circuit device being operative at a lower power supply voltage.

Gain-cell circuits employing logarithmic transformation circuits are known, a typical one of which is described, for example, in Published Unexamined Japanese Patent Application No. 61-224715. A gain-cell circuit described therein is used as the main constituent of an active filter circuit. The gain-cell circuit includes in its input stage a logarithmic transformation circuit. An inverse logarithmic transformation circuit is arranged in the output stage of the gain-cell circuit. The logarithmic transformation circuit and the inverse logarithmic transformation circuit are connected between a power supply voltage line and a ground potential line.

The logarithmic transformation circuit essentially consists of a parallel circuit of two pairs of series-connected semiconductor bipolar transistors, resistive elements connected to an intermediate common connection node of each transistor pair, and a constant current source unit associated therewith. The resistive elements are called the "degeneration resistors." The output-stage inverse logarithmic transformation circuit includes a pair of bipolar transistors and another constant current source unit connected therewith.

In the logarithmic transformation circuit, the bipolar transistors on the power-supply voltage side of the above transistor pairs have the base electrodes which serve as input terminals for positive and negative input voltage signals +vin, −vin. The remaining transistors of the transistor pairs reside on the ground potential side, and each of them is diode-connected. The collector current Ic of each diode-connected transistor and the voltage between the base and emitter electrodes (base-to-emitter voltage) vbe satisfies a specific relation defined as follows: $vbe=\alpha.\ln(Ic)$, where "ln" is the mathematical symbol representing a natural logarithm. Accordingly, a specific voltage is output by the input-stage transistors on the power supply voltage side in the transistor pairs, the specific voltage being developed as a result of each of the collector currents being logarithmically converted into the base-to-emitter voltage vbe of a corresponding diode-connected transistor. The output voltage is supplied to the base electrodes of the bipolar transistors constituting the inverse logarithmic transformation circuit. As a result, a signal equivalent to a linear-converted input voltage signal vin (i.e., the difference between input voltages +vin, −vin) of the input-stage logarithmic transformation circuit appears at the collector electrodes of these bipolar transistors constituting the inverse logarithmic transformation circuit.

As is known among those skilled in the art, the electric equivalent circuitry of a "half circuit" of the logarithmic transformation circuit may typically be represented by a series circuit of the "degeneration" resistors coupled between the input voltage +vin and the ground potential GND, and a conductance component gm coupled between an intermediate common connection node of the resistors and the ground. The transconductance Gm of this half circuit may be defined by:

$$\begin{aligned} Gm &= gm/(2+gm\cdot re) \\ &= 1/\{2/(gm+re)\}, \end{aligned}$$

where "re" is the resistance of the resistors.

The above equation indicates that it is necessary to maintain a variation of the value "2/gm" negligibly as much as possible with respect to the resistance "re" in order to enable the logarithmic transformation circuit to operate in an expanded dynamic range of voltage amplitude of the input signal +vin to expand the linear operation range as desired. Otherwise, an undesirable variation will occur in the base-to-emitter voltage vbe of the bipolar transistor, which results in a distortion being generated. The value "2/gm" is determined depending on variation in the operating current of corresponding two transistors. With a conventional circuit design scheme, decreasing the value "2/gm" is attained by forcing an increased current to flow in these transistors. The supplement of the large current to the transistors, however, comes with one disadvantage: Obviously, supplying large current leads to an increase in the total power consumption of the logarithmic transformation circuit.

SUMMARY OF THE INVENTION

It is therefore an object of the present invention to provide a new and improved logarithmic transformation circuit.

It is another object of the invention to provide a new and improved logarithmic transformation circuit which can suppress or eliminate the occurrence of distortion in a logarithmically transformed signal.

It is a further object of the invention to provide a new and improved semiconductor integrated circuit device including a logarithmic transformation circuit that can operate successfully throughout an expanded range of input signal amplitude, while suppressing or eliminating the occurrence of distortion without causing the power consumption to increase.

In accordance with the above objects, the invention is drawn to a specific logarithmic transformation circuit device, which includes a pair of transistors arranged between first and second potentials. These transistors have first current-carrying electrodes being commonly connected to each other and coupled to one of the first and second potentials, second current-carrying electrodes coupled to the other of the first and second potentials, and control electrodes coupled to output terminals of the circuit device. An impedance element is provided to have first and second end portions or nodes connected to the second current-carrying electrodes of the transistors. A voltage generator section is provided to receive input signals being externally supplied thereto, causing a certain voltage indicative of a potential difference between the input signals to generate at the first and second nodes of the impedance element.

The voltage generator section may include another or second pair of transistors and a feedback section. The second pair of transistors have control electrodes coupled to the input signals, first current-carrying electrodes coupled to the first and second nodes of the impedance element, and second current-carrying electrodes coupled to the above-identified one of the first and second potential. The feedback section is connected to the control electrodes of the first pair of transistors and to the second current-carrying electrodes of the second pair of transistors, for causing an output current of the second pair of transistors to be fed back to the control electrodes of the first pair of transistors. In the alternative, the voltage generator section may include a pair of differential amplifiers, which have first inputs coupled to the input signals, second inputs coupled to the first and second nodes of the impedance element, and outputs connected to the control electrodes of the first pair of transistors.

The foregoing and other objects, features, and advantages of the invention will become apparent from the following more particular description of preferred embodiments of the invention, as illustrated in the accompanying drawings.

DETAILED DESCRIPTION OF THE PREFERRED EMBODIMENTS

Figure 1:
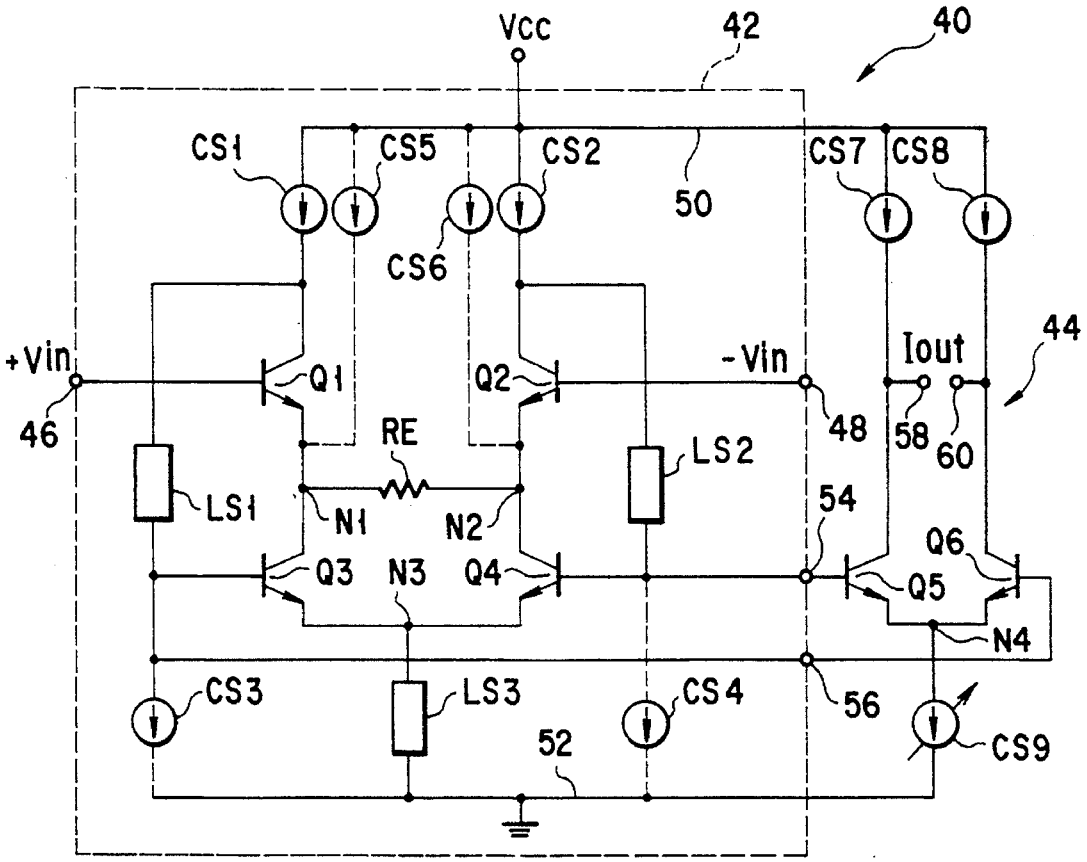
FIG. 1 is a diagram schematically showing the overall circuit configuration of a gain-cell circuit including a logarithmic transformation circuit in accordance with one preferred embodiment of the invention.

Referring now to FIG. 1, a gain cell circuit including a logarithmic transformation circuit in accordance with one preferred embodiment of the invention is generally designated by the numeral 40. The gain cell circuit 40 includes in its input stage a logarithmic transformation circuit 42. Gain cell circuit 40 also includes an inverse logarithmic transformation circuit 44 arranged in the output stage of it.

The logarithmic transformation circuit 42 includes four NPN type semiconductor bipolar transistors Q1, Q2, Q3 and Q4. The transistors Q1 and Q2 constitute a differential input circuit. Transistors Q1, Q2 have base electrodes connected respectively to first and second input signal terminals 46, 48, to which a positive input voltage +Vin and a negative input voltage −vin are externally supplied, respectively. Transistors Q1, Q2 have collector electrodes, which are connected to a power supply voltage line 50 by way of constant current sources CS1, CS2 respectively. This wiring line 50 is coupled to a power supply voltage vcc of positive polarity. Constant current sources CS1, CS2 act as collector loads.

The bipolar transistors Q1, Q2 are connected at their emitter electrodes to the collector electrodes of NPN type bipolar transistors Q3, Q4, respectively. Transistors Q3, Q4 are provided to set symmetry between the right-hand input and the left-hand input of the differential input stage. A resistive elements RE is provided as an impedance device and is connected between circuit nodes N1, N2 whereat the emitter electrodes of transistors Q1, Q2 are coupled to the collectors of transistors Q3, Q4. The resistor RE is called the "degeneration resistor" among those skilled in the art of electronic circuit. The collectors of transistors Q1, Q2 are connected through first and second level-shift circuits LS1, LS2 to the bases of transistors Q3, Q4, respectively. The emitters of transistors Q3, Q4 are coupled to each other at a circuit node N3. Node N3 is coupled via a third level-shift circuit LS3 to a wiring line 52 being held at the ground potential.

Constant current source units CS3, CS4 may be provided between the bases of the transistors Q3, Q4 and the ground (GND) potential line 52. Constant current sources CS5, CS6 may be additionally arranged between the emitters of differential input transistors Q1, Q2 and the power supply voltage (vcc) line 50.

As shown in FIG. 1, the bases of transistors Q3, Q4 are coupled to a pair of output terminals 54, 56 of the logarithmic transformation circuit 42. The inverse logarithmic transformation circuit 44 is connected to these output terminals. More specifically, inverse logarithmic transformation circuit 44 includes a pair of NPN type bipolar transistors Q5, Q6, which have bases being connected to output terminals 54, 56, respectively. Transistors Q5, Q6 constitute a differential amplifier. Transistors Q5, Q6 have collectors, which are coupled to output terminals 58, 60, respectively. These collectors are also coupled to the power supply voltage vcc by way of constant current sources CS7, CS8, respectively. These current sources CS7, CS8 act as active loads for transistors Q5, Q6. Transistors Q5, Q6 have emitters being coupled together at a circuit node N4, which is coupled to the ground potential through a common constant-current source CS9. An output current signal Iout of the gain cell circuit 40 is developed at output terminals 58, 60 and will be taken out of it externally.

In the gain cell circuit 40, the input signal component vin may be represented by the difference in amplitude between the input voltages +vin, −vin being applied to the input terminals 46, 48. Input signal vin is first subjected to a logarithmic transformation performed by the logarithmic transformation circuit 42. More specifically, an equivalent voltage to input signal vin is supplied to the bipolar transistors Q1, Q2 to obtain an emitter current proportional in potential to the input signal. The relation between collector current Ic of transistors Q3, Q4 and the base-to-emitter voltage Vbe thereof is defined as follows:

$$Vbe=\alpha\cdot ln(Ic), \quad (1)$$

where "α" is a proportional constant. Due to this relationship, voltages to be generated at output terminals 54, 56 reflect a specific value of voltage that the collector current of transistors Q3, Q4 is logarithmically transformed into the base-to-emitter voltage of transistors Q3, Q4.

The voltages at the logarithmic transformation output terminals 54, 56 are supplied to the bases of the transistors Q5, Q6, which are included in the inverse logarithmic transformation circuit 44. Thus, a current signal Iout, which is linear-converted from the input signal vin of the input-stage logarithmic transformation circuit 42, is generated at the collectors of transistors Q5, Q6. Note here that the constant current source CS9 common-connected to the emitters of transistors Q5, Q6 in inverse logarithmic transformation circuit 44 may vary in the current value, and that the total gain (i.e., the transconductance) of gain cell circuit 40 can be desirably changed by changing the current value.

The operation of the logarithmic transformation circuit 42 is described with reference to FIG. 2, which shows the electric equivalent circuit that is presented to facilitate the understanding of the operation principle of logarithmic transformation circuit 42. Since embodiment circuit 42 exhibits a differential function, the equivalent circuit of FIG. 2 is shown in the form of what is called the "half circuit."

Figure 2:
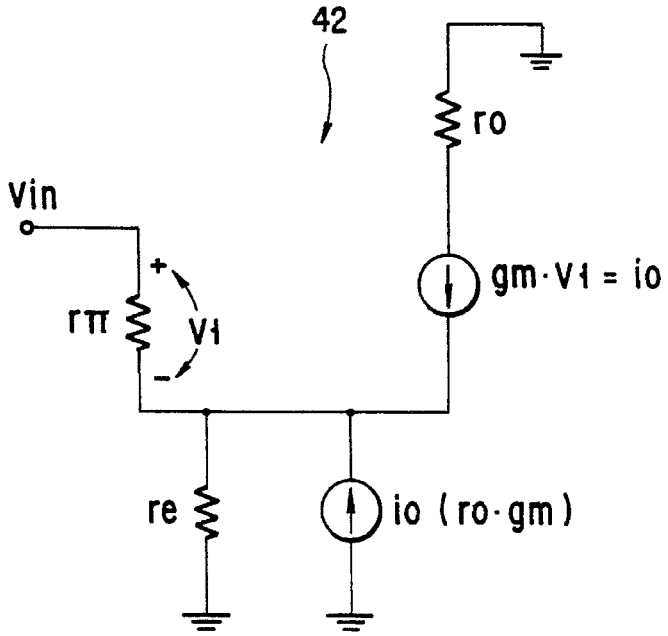
FIG. 2 illustrates the equivalent circuit of the embodiment of FIG. 1.

In the circuit of FIG. 2, a resistive element rπ represents the input resistance of the bipolar transistors Q1, Q2 of FIG. 1. Resistor rπ has one end portion or node coupled to the input signal vin, and the other node coupled to the ground potential GND through the "degeneration" resistor RE of FIG. 1 having resistance value re. Resistance value re may be assumed to be a resistive element which has a resistance value half that of the "degeneration" resistor RE. The other node of input resistor rπ is coupled to the ground potential by way of a transistor conductance component gm and a resistance component ro. Assume the voltage on resistor rπ is vl, transistor conductance component gm defines a current source gm·vl (=io), where "io" is a current of current source. Characteristically, a current source component io·(ro·gm) is added in parallel with resistor re. This current source is grounded at one end thereof. Current source io·(ro·gm) shows the current amplifying operation to be performed by the transistors Q3, Q4 of FIG. 1. Adding such current source io·(ro·gm), that is, the current amplifying function of transistors Q3, Q4, can increase or expand the total transconductance of the logarithmic transformation circuit 42.

In the alternative explanation, the transistors Q3, Q4 of the inverse logarithmic transformation circuit 44 of FIG. 1 provide the function and advantage of a current source for generating a current that is ro·gm times the current-source current io in the prior art equivalent circuit previously described in the introductory part of the description. The ratio Gm2 between the collector current of transistor Q3 and a signal voltage +vin to be input to the base of transistor Q1 may be defined by $$Gm2=gm\cdot ro\cdot gm/\{2+gm(1+ro\cdot gm)\cdot re\}. \quad (2)$$

In Equation 2, assume n=1+ro·gm, and ro·gm>>1. Then, Equation 2 may be expressed simply as follows:

$$Gm2=1/\{2/(1+gm\cdot n)+re\}. \quad (3)$$

Comparing Equation 2 with Equation 1, it may be understood that, with the present embodiment, the conductance gm is increased to be n times. This tells us that advantages can be obtained which corresponds to the advantages of achievement of an increased transconductance by increasing current flowing in transistors Q1, Q2 in the alternative of increase in the actual value of gm. Such advantages are mainly derived from the cooperation of the resistor RE being inserted between the nodes N1, N2 as an impedance element and the level-shift circuits LSl, LS2 for causing current to be fed back from the collectors of transistors Q1, Q2 to the bases of transistors Q3, Q4. The output current appearing at the collectors of transistors Q1, Q2 for amplifying an input signal vin is further amplified by transistors Q3, Q4, thereby to cause the effective current component for driving resistor RE to be greater by the multiplicative of (1+gm·n). As a result, it becomes possible to suppress or prevent the occurrence of distortion, without actually increasing the operating current (current consumption) of the logarithmic transformation circuit 42, to enable a successful logarithmic transformation operation to be performed at an improved signal-to-noise ratio throughout an expanded range of voltage amplitude for input signal vin. Regarding the gain cell circuit 40, the advantages lead to an expansion of the linear operating range.

Another significant advantage of the embodiment 40 is that it can achieve a low-voltage operation in comparison with the prior-art logarithmic transformation circuits, as will be described below. Now, let us discuss the minimum voltage required for the normal operation of the gain cell circuit 40 of FIG. 1. The lower limit of the input signal vin to be supplied to the bases of the transistors Q1, Q2 of FIG. 1 may be defined as the sum of a voltage vce needed to operate the current source CS9 (actually, the saturation voltage of a transistor used in current source CS9 is approximately 0.2 volts), the base-to-emitter voltage vbe (approximately, 0.7 volts) of transistors Q1, Q2, and the saturation voltage of transistors Q3, Q4 (approximately 0.2 volts). The lower limit value vmin is represented by $$Vmin=Vbe+2Vce=0.7+2\times0.2=1.1. \quad (4)$$

Applying the similar calculation to the prior art described in the introductory part of the description, the minimum required voltage vmin for the operation of the conventional logarithmic transformation circuit is given as $$Vmin=2Vbe+Vce=1.6. \quad (5)$$

Comparing Equations 4 and 5 with each other, it is to be understood that the minimum operating voltage vmin of the embodiment 40 is less by 0.5 volts than that of the prior art. In other words, assuming that the amplitude width of input signal that is determined depending on the practical circuit design is constant, the logarithmic transformation circuit 42 can be permitted to be lower in its power supply voltage Vcc than the prior art by 0.5 volts. This means that there can be expected the possibility of low-power supply voltage operation of logarithmic transformation circuit 42. In another point of view, if the power supply voltage Vcc is predetermined in accordance with the circuit specification, logarithmic transformation circuit 42 can be increased or expanded by 0.5 volts than the prior art in the allowable voltage amplitude range for input signals.

The upper limit vmax of the input signal voltage Vin of the logarithmic transformation circuit 42 is discussed as follows. The upper limit value Vmax may be defined as a value that is calculated by subtracting from power supply voltage vcc the necessary voltage (ordinarily, about 0.2 volts) that is required to cause the current sources CS7, CS8 to operate normally under an assumption that the level-shift amount of the level-shift circuits LS1, LS2 of FIG. 1 is selected suitably. The input-signal upper-limit value vmax may be represented by a difference between the power supply voltage Vcc and the saturation voltage Vce as defined as follows:

$$Vmax=Vcc-Vce. \quad (6)$$

In view of the above discussions, a resultant voltage amplitude range vsig for the input signal vin that contributes to the signal amplification of the logarithmic transformation circuit 42 of FIG. 1 is taken from the Equations 4 and 6 as follows:

$$\begin{aligned} Vsig &= Vmax - Vmin \\ &= (Vcc - Vce) - (Vbe + 2Vce) \\ &= Vcc - (Vbe + 3Vce) \\ &= Vcc - 1.3. \end{aligned} \quad (7)$$

Modifying Equation 7, the necessary power supply voltage Vcc of logarithmic transformation circuit 42 when the voltage amplitude value Vsig of input signal Vin is given first is represented by $$Vcc=Vsig+1.3. \quad (8)$$

Equations 7 and 8 support evidently the aforementioned "input signal amplitude expansion" possibility or the "lower power supply voltage driving" capability of the invention. In addition, the logarithmic transformation circuit 42 can be permitted to be constituted by using the same conductivity or polarity of bipolar transistors only. In the case wherein only the NPN type bipolar transistors are used as shown in FIG. 1, a resultant gain cell circuit 40 will be improved in the frequency characteristics. This can be said because such NPN type bipolar transistors, unlike PNP type bipolar transistors, are inherently high in the cut-off frequency ft.

In the gain cell circuit 40, current sources CS3, CS4, CS5, CS6 are arranged as needed. Current sources CS3, CS4 are arranged to determine the operating currents of level-shift circuits LS1, LS2. In view of frequency characteristics, the operating currents of the transistors Q3, Q4 can be set to be appropriate values by properly changing the current values of the current sources CS3, CS4. When current sources CS5, CS6 are additionally provided, transistors Q3, Q4 become greater in operating current than transistors Q1, Q2. This enables the logarithmic transformation circuit 42 to become higher in the input impedance thereof. When a circuit is connected to the input stage of logarithmic transformation circuit 42, a load viewed from the connected circuit is reduced to make it easier to drive logarithmic transformation circuit 42.

Figure 3A:
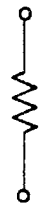
FIGS. 3A through 3K are a plurality of circuit diagrams showing the internal configuration of level-shift circuits connected to the base electrodes of input transistors of FIG. 1, and FIGS. 4A to 4E are circuit diagrams showing the internal configuration of a level-shift circuit arranged between the commonly connected emitter electrodes of the input transistors and the ground potential.
Figure 3B:
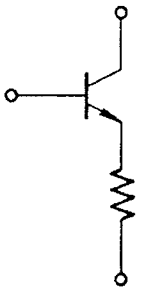
Figure 3C:
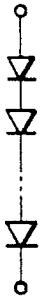
Figure 3D:
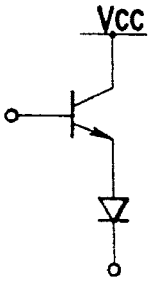
Figure 3E:
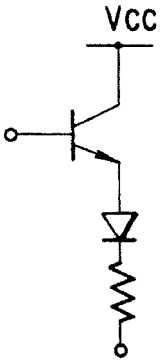
Figure 3F:
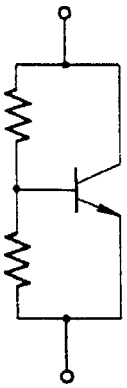
Figure 3G:
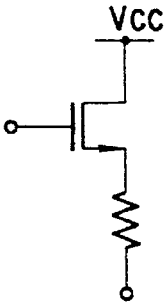
Figure 3H:
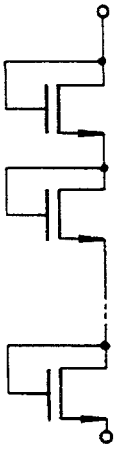
Figure 3I:
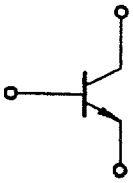
Figure 3J:
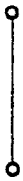
Figure 3K:
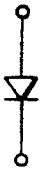
Figure 4A:
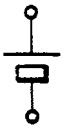
Figure 4B:
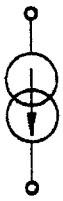
Figure 4C:
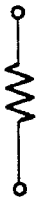
Figure 4D:
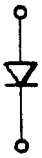
Figure 4E:
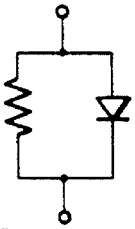

FIGS. 3A to 3H illustrate detailed arrangements of the level-shift circuits LS1, LS2 in the logarithmic transformation circuit 42 of FIG. 1. As shown in FIG. 3A, each of level-shift circuits LS1, LS2 is constituted by a resistor. Each level-shift circuit LS1, LS2 may also be constituted by any one the following alternatives: an emitter-follower comprising a transistor and a resistor (see FIG. 3B); series-connected diodes (FIG. 3C); a circuit as a combination of a transistor and a diode (FIG. 3D); a circuit as a combination of a transistor, a diode, and a resistor (FIG. 3E); a constant-voltage circuit using a transistor and a resistor (FIG. 3F); a source follower using an FET and a resistor (FIG. 3G); and a circuit constituted by a plurality of series-connected FETs whose drains and gates are connected to each other (FIG. 3H). The level-shift circuit may alternatively be constituted by an emitter-follower circuitry consisting of a transistor (FIG. 3I), or a wiring line (FIG. 3J) or a diode (FIG. 3K).

FIGS. 4A to 4E show several possible detailed arrangements of the level-shift circuit LS3 in the logarithmic transformation circuit 42 of FIG. 1. Level-shift circuit LS3 is connected between the emitters of the transistors Q3, Q4 of FIG. 1 and the ground potential GND, for forcing the emitter potentials of transistors Q5, Q6 of the inverse logarithmic transformation circuit 44 to be at a certain potential for driving the current source CS9. Level-shift circuit LS3 may be constituted by a DC voltage source (FIG. 4A), a current source (FIG. 4B), a resistor (FIG. 4C), a diode (FIG. 4D), a series circuit of a resistor and a diode (FIG. 4E), or a circuit as combinations selected from the arrangements in FIGS. 4A to 4E.

In the logarithmic transformation circuit 42 shown in FIG. 1, it may possibly occur be possibly occurred that the input signal voltage is not converged to symmetrical values with respect to the two input terminals 46, 48, depending on the initial conditions, thus causing an unstable operation of the logarithmic transformation circuit 42. If this is the case, by using either the diode (FIG. 4D) or the series circuit of the resistor and the diode (FIG. 4E) as the level-shift circuit LS3, the emitter potential of each transistor Q3, Q4 can be kept at 0.7 volts or less, thereby preventing circuit unbalance and allowing to set symmetrical voltage values about the ordinate.

Figure 5:
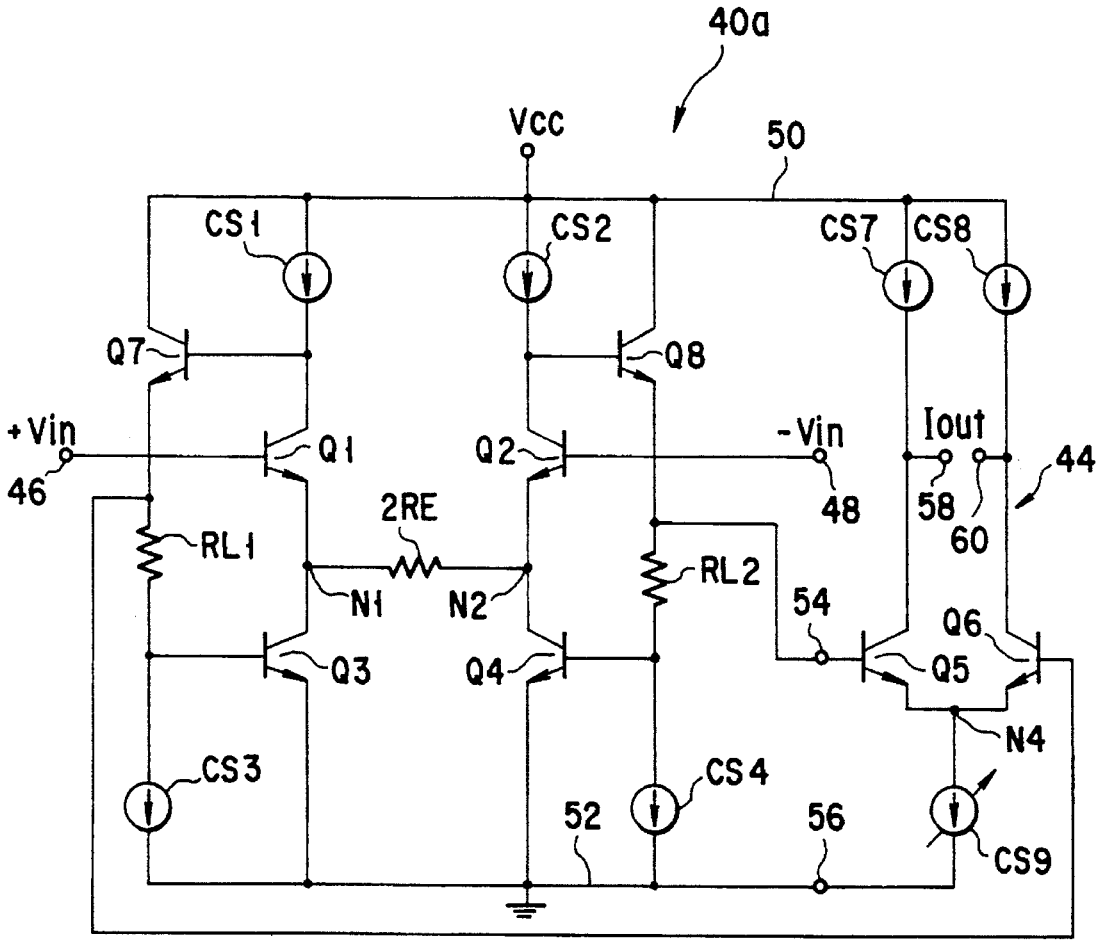
FIG. 5 is a circuit diagram of a modification of the gain-cell circuit shown in FIG. 1.

A gain cell circuit 40*a* shown in FIG. 5 has a detailed circuit configuration arranged based on the of the level-shift circuits CS1, CS2 of FIG. 1 is constituted by an emitter-follower circuitry consisting of transistors Q7, Q8 and resistors RL1, RL2. The bases of the transistors Q5, Q6 in the inverse logarithmic transformation circuit 44 at the output stage are connected to the emitters of transistors Q7, Q8 which serve as the output nodes of the emitter follower. With such an arrangement, the same effects as the previous embodiment of FIG. 1 can be obtained.

Figure 6:
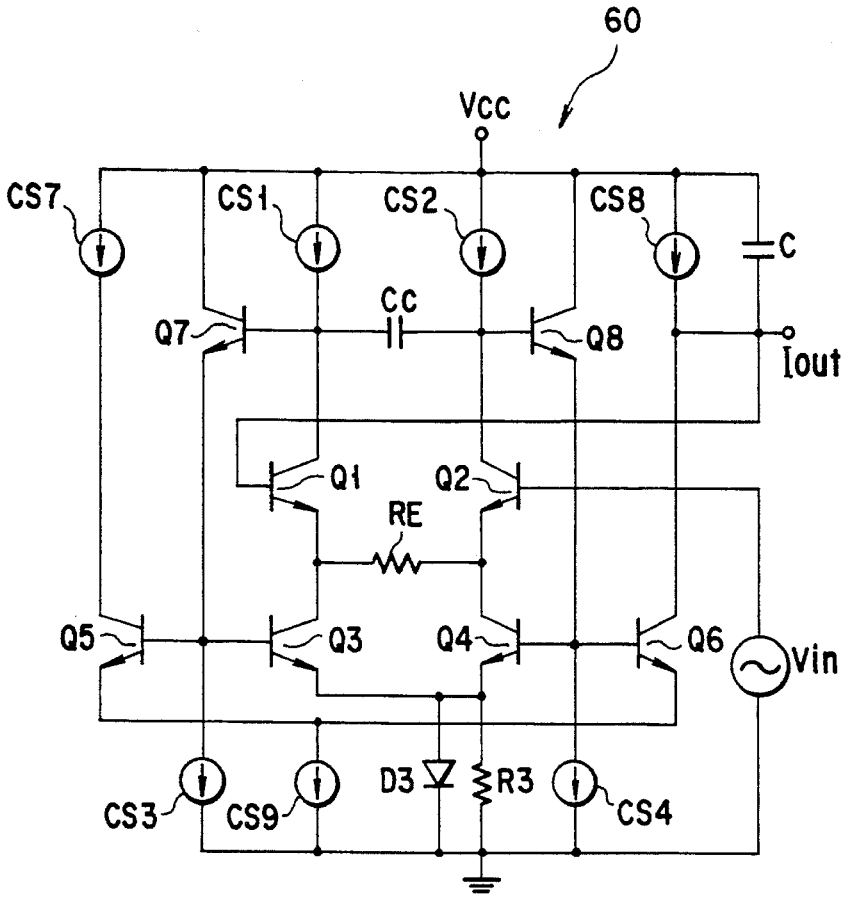
FIG. 6 is a diagram schematically showing the entire circuit configuration of a primary low-pass filter circuit which is constituted by using the gain-cell circuit containing the logarithmic transformation circuit of the invention.

FIG. 6 shows a primary low-pass filter 60 which uses the gain cell circuit including the logarithnic transformation circuit of the invention. A capacitor C is connected in parallel with a current source CS8 as one load in the inverse logarithmic transformation circuit in the gain cell circuit 40 of FIG. 1. An output of the inverse logarithmic transformation circuit is fed back to the base of the transistor Q1 which serves as one input terminal of the logarithmic transformation circuit. A phase compensation capacitor Cc is arranged to cancel a zero point by a feedback loop.

In the low-pass filter 60 of FIG. 6, while the level-shift circuits LS1, LS2 are constituted by series-connecting the transistors Q7, Q8 and diodes D1, D2, it is possible to use any one of the level-shift circuits shown in FIGS. 3A to 3H. The level-shift circuit LS3 of FIG. 1 is constituted by a parallel circuit of a diode D3 and a resistor R3 of FIG. 6; however, any one of the level-shift circuits shown in FIGS. 4A to 4E can be used. With this arrangement, the voltage amplitude range of the input signal can be increased without increasing power consumption.

Figure 7:
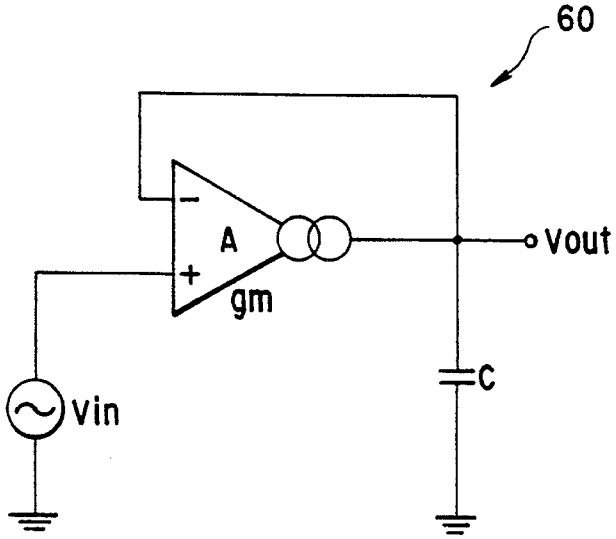
FIG. 7 is its equivalent circuit diagram.
Figure 8:
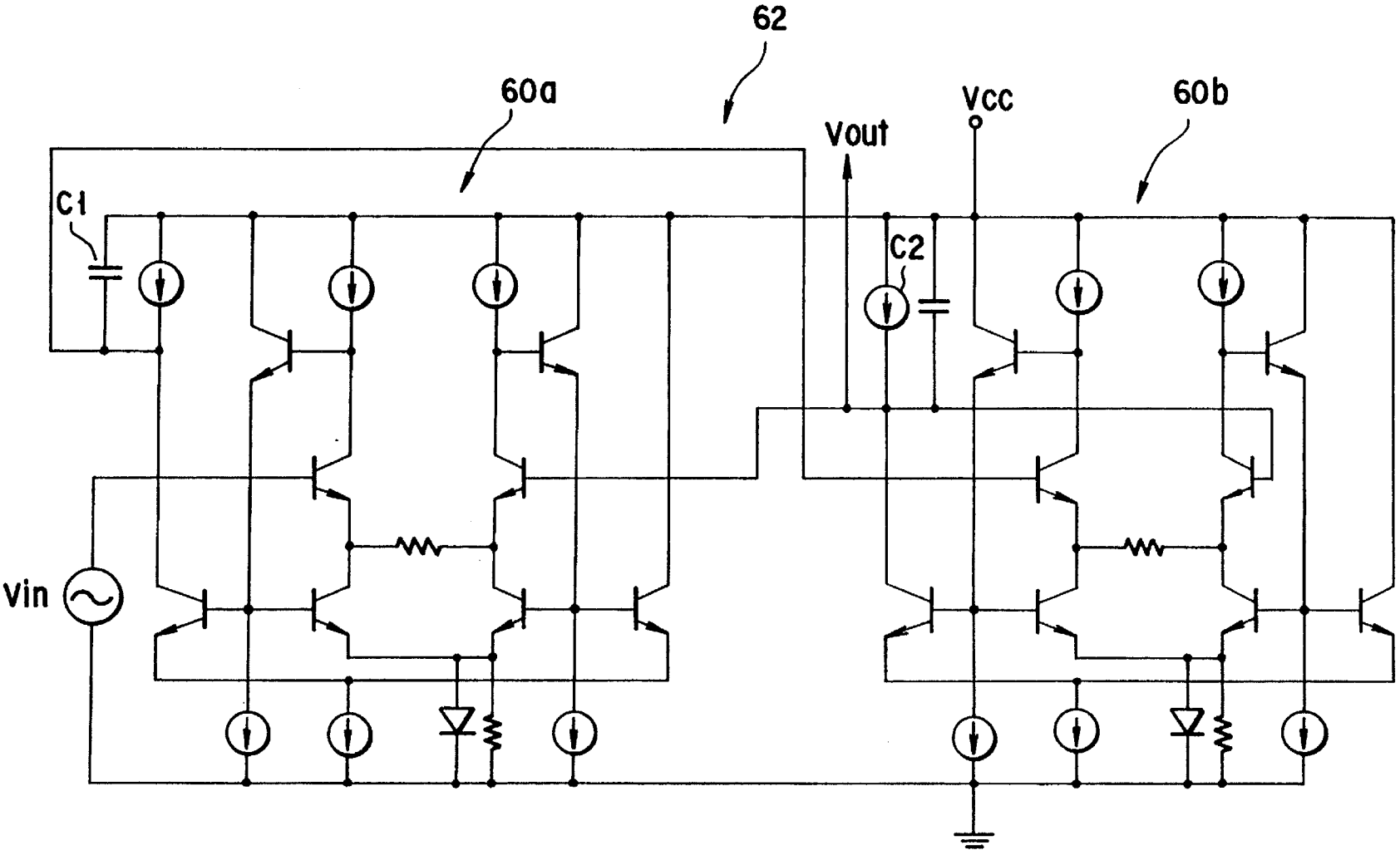
FIG. 8 is a diagram schematically showing the entire circuit configuration of a secondary low-pass filter circuit which is constituted by using the gain-cell circuit containing the logarithmic transformation circuit of the invention.

The equivalent circuit of the primary low-pass filter 60 is shown in FIG. 7, wherein the gain cell circuit is expressed by a voltage-controlled current source A having a transconductance gm. It is apparent from this equivalent circuit that the frequency characteristics of the low-pass filter can be expressed as a function of gm/C. In FIG. 8, a secondary low-pass filter 62 is shown which is obtained by series-connecting two primary low-pass filters 60*a*, 60*b*, each of which is similar to that of FIG. 6. with such an arrangement, a filter having a wider input signal voltage amplitude range which allows the linear operation can be arranged.

Figure 9:
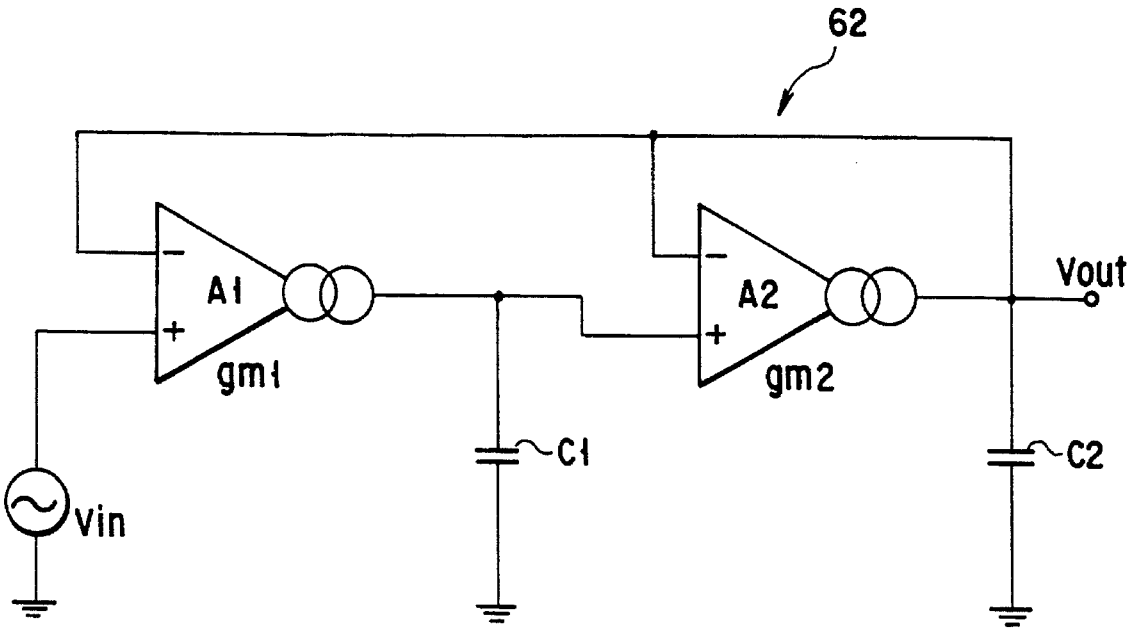
FIG. 9 is its equivalent circuit diagram.

The equivalent circuit of the secondary low-pass filter 62 is shown in FIG. 9. The gain cell circuit is represented by voltage-controlled current sources A1, A2, and the transconductances of the voltage-controlled current sources A1, A2 are represented by gm1 and gm2. By changing the characteristics of elements such as a capacitor C1 connected to the gain cell circuit of the former stage and a capacitor C2 connected to the gain cell circuit of the latter stage, the characteristics of the low-pass filter can be changed to an arbitrary cutoff frequency. Even after the capacitance values of capacitors C1, C2 are fixed, the transconductances gm1, gm2 of voltage-controlled current sources A1, A2 can be changed, so that an active filter having a larger degree of freedom can be realized.

Figure 10:
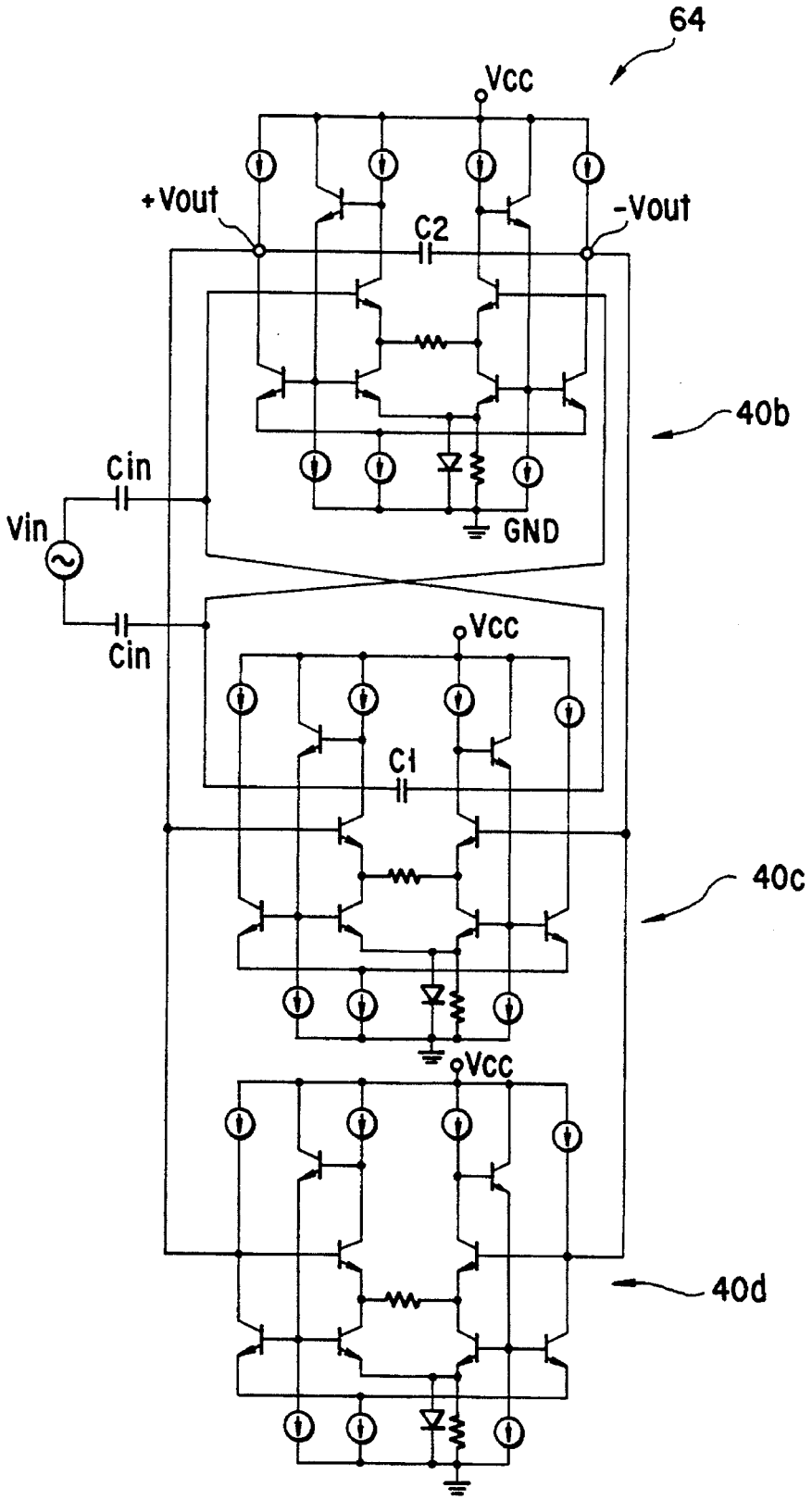
FIG. 10 is a diagram schematically showing the entire circuit configuration of a secondary band-pass filter circuit which is constituted using the gain-cell circuit containing the logarithmic transformation circuit of the invention.

A secondary band-pass filter 64 shown in FIG. 10 includes three gain cell circuits 40*b*, 40*c*, 40*d*, each of which is equivalent in configuration to the gain cell circuit 40 of FIG. 1. Of these gain cell circuits, the gain cell circuits 40*b*, 40*c* serve as voltage-controlled current sources, and the gain cell circuit 40*d* serves as a variable resistive element. In this case, the output polarity of the gain cell circuits 40*b*, 40*c* may be reversed to realize a negative feedback operation, thereby providing a band-pass filter function.

Figure 11:
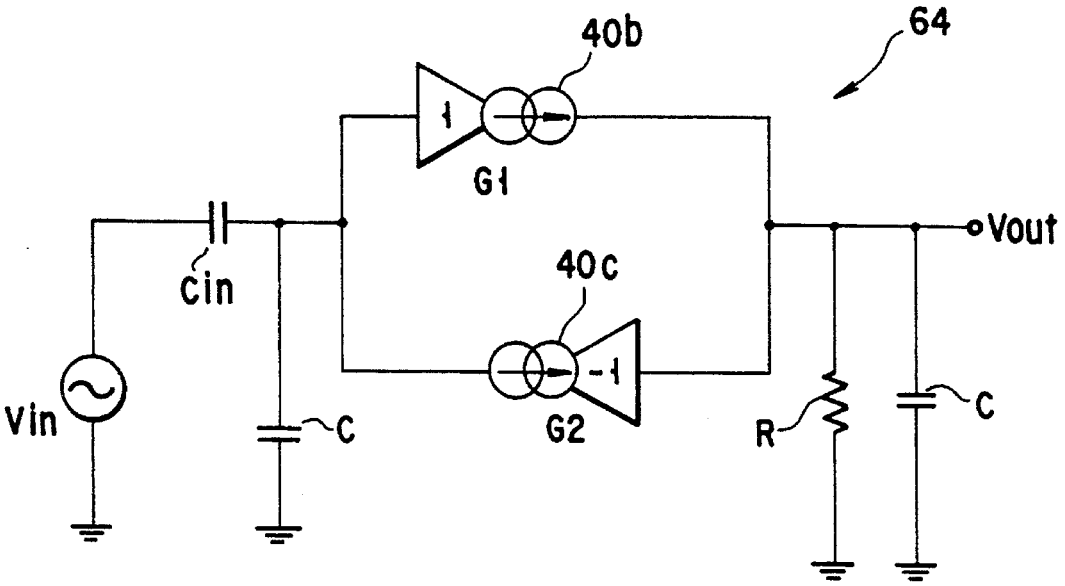
FIG. 11 is its equivalent circuit diagram.

The equivalent circuitry of the secondary band-pass filter 64 is shown in FIG. 11. The transfer function is obtained from this equivalent circuit; then, the bandpass filter characteristics are obtained. The center frequency fo is represented as follows:

$$2\pi fo^2 = gm2/\{C(C+Cin)\}, \tag{9}$$

where Cin is the value of the input capacitor, C is the value of each of the capacitors C1, C2 being arranged as loads of the gain cell circuits 40*b*, 40*c*, and gm is a transconductance of each gain cell circuit 40*b*, 40*c*. As is apparent from Equation 9, the characteristics of band-pass filter 64 are determined by the transconductance of each gain cell circuit being practically used and the value of each capacitor. Note that a secondary low-pass filter, a high-pass filter, and a notch filter can be arranged by using the gain cell circuit 40 of FIG. 1 as the voltage-controlled current source.

Figure 12A:
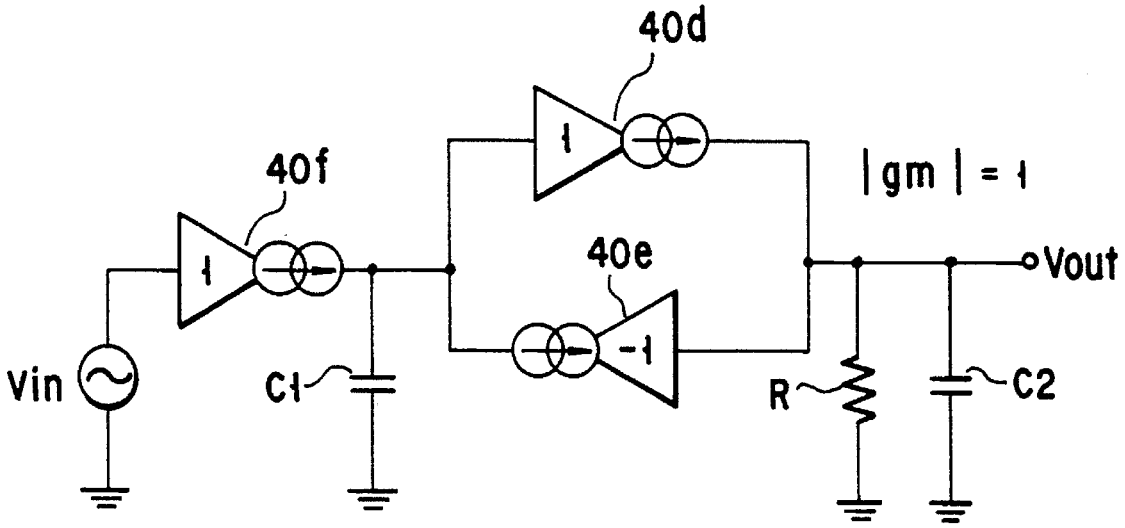
FIGS. 12A and 12B are circuit diagrams of two possible modifications of the low-pass filter each constituted using the gain-cell circuit containing the logarithmic transformation circuit of the invention.
Figure 12B:
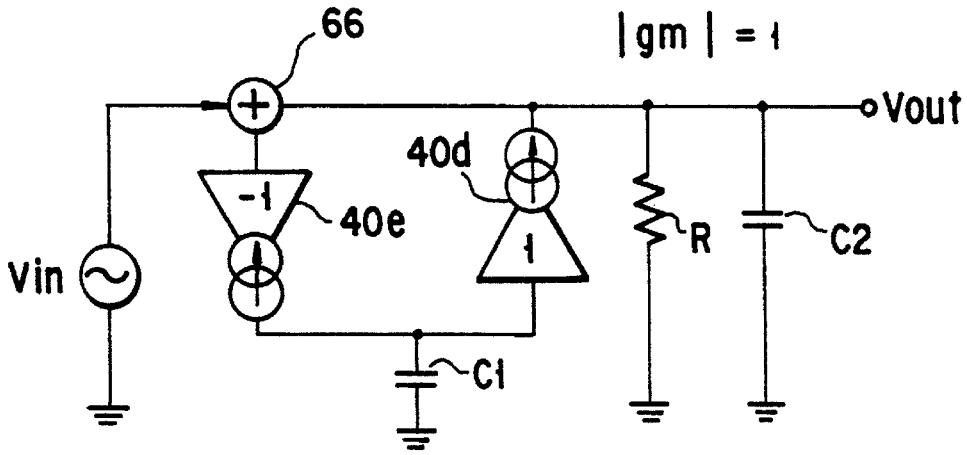

FIGS. 12A and 12B show two possible arrangements of the low-pass filter. In either case, two gain cell circuits 40*d*, 40*e* are connected with each other in an inverse-parallel manner to constitute a negative feedback circuit. In the circuitry of FIG. 12A, a gain cell circuit 40*f* is arranged also in the input stage. In the circuitry of FIG. 12B, an adder 66 is added to the input stage. The characteristics of each low-pass filter are determined in accordance with the capacitor, the resistor, and the transconductance of the voltage-controlled current source, which are connected in the corresponding low-pass filter. The characteristic of the low-pass filter obtained from the transfer function is represented as follows:

$$Vout/Vin = \omega o^2/(s^2+\omega o^2 s/Q+\omega o^2), \tag{10}$$

$$(\text{for } \omega o^2 = 1/C1\cdot C2,\ Q = R(C1/C2)^2).$$

In this case, also, the filter characteristics can be changed to comply with the design specifications by changing the transconductances of the gain cell circuits 40*d*, 40*e*, 40*f*.

Figure 13:
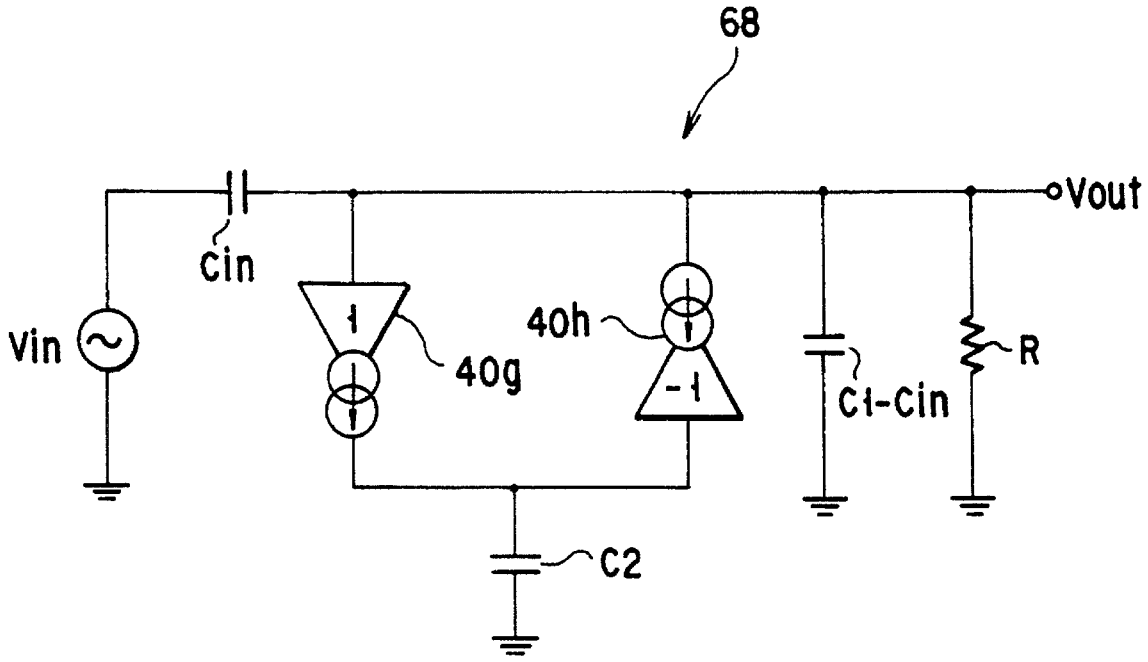
FIG. 13 is a circuit diagram of a high-pass filter constituted using the gain-cell circuit containing the logarithmic transformation circuit of the invention.

A high-pass filter 68 shown in FIG. 13 employs two gain cell circuits 40*g*, 40*h*. The characteristic of this high-pass filter obtained by the transfer function is represented as follows:

$$Vout/Vin = \{(Cin/C1)s^2\}/\{(s^2+s/RC1+1/C1C2\} \tag{11}$$

$$(\text{for } \omega o = 1/C1C2,\ Q = R(C1/C2)^2).$$

Figure 14:
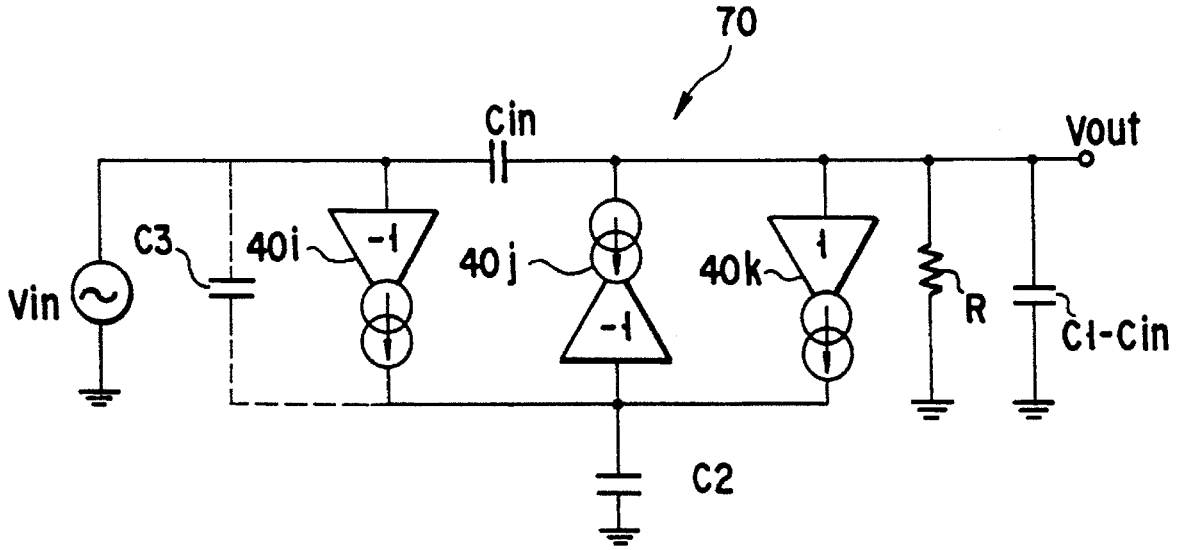
FIG. 14 is a circuit diagram of a notch filter constituted using the gain-cell circuit containing the logarithmic transformation circuit of the invention.

A notch filter 70 shown in FIG. 14 includes three gain cell circuits 40*i*, 40*j*, 40*k*. The transfer function of this notch filter is defined by $$Vout/Vin = \{-Cin\cdot s^2/C1+1/C1C2\}/\{s^2+s/RC1+1/C1C2\}, \tag{12}$$

(for $\omega o=1/C1C2$, $Q=R(C1/C2)^2$, $\omega o^2=1/CinC2$).

From this transfer function, the frequency characteristic and resonance characteristic can be determined. If a capacitor C3 is connected in the input stage, the resultant filter is an all-pass filter.

Figure 15:
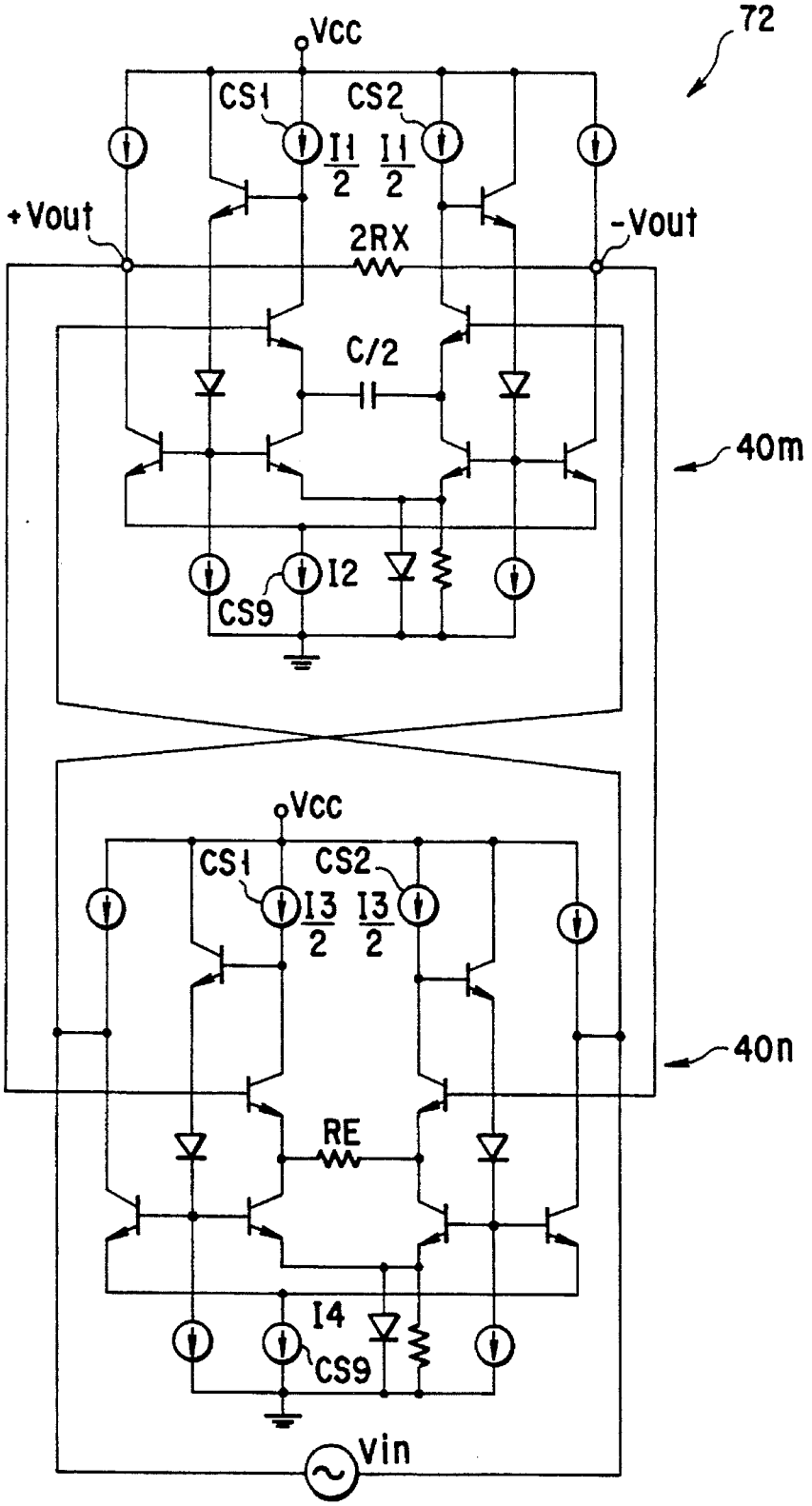
FIG. 15 is a diagram showing the overall configuration of an impedance conversion circuit constituted using the gain-cell circuit containing the logarithmic transformation circuit of the invention.

An impedance varying circuit 72 shown in FIG. 15 employs the gain cell circuit 40 including the logarithmic transformation circuit of the invention. Impedance varying circuit 72 includes two gain cell circuits 40*m*, 40*n*. The impedance varying circuit is defined as the circuitry capable of electrically increasing and decreasing the impedances of the resistance and the capacitance. Since such an impedance varying circuit can change the values of the capacitive and resistive elements even if the impedance varying circuit is arranged in a semiconductor chip, the impedance varying circuit is utilized as a variable impedance element internally arranged in integrated circuit devices (ICs).

Figure 16:
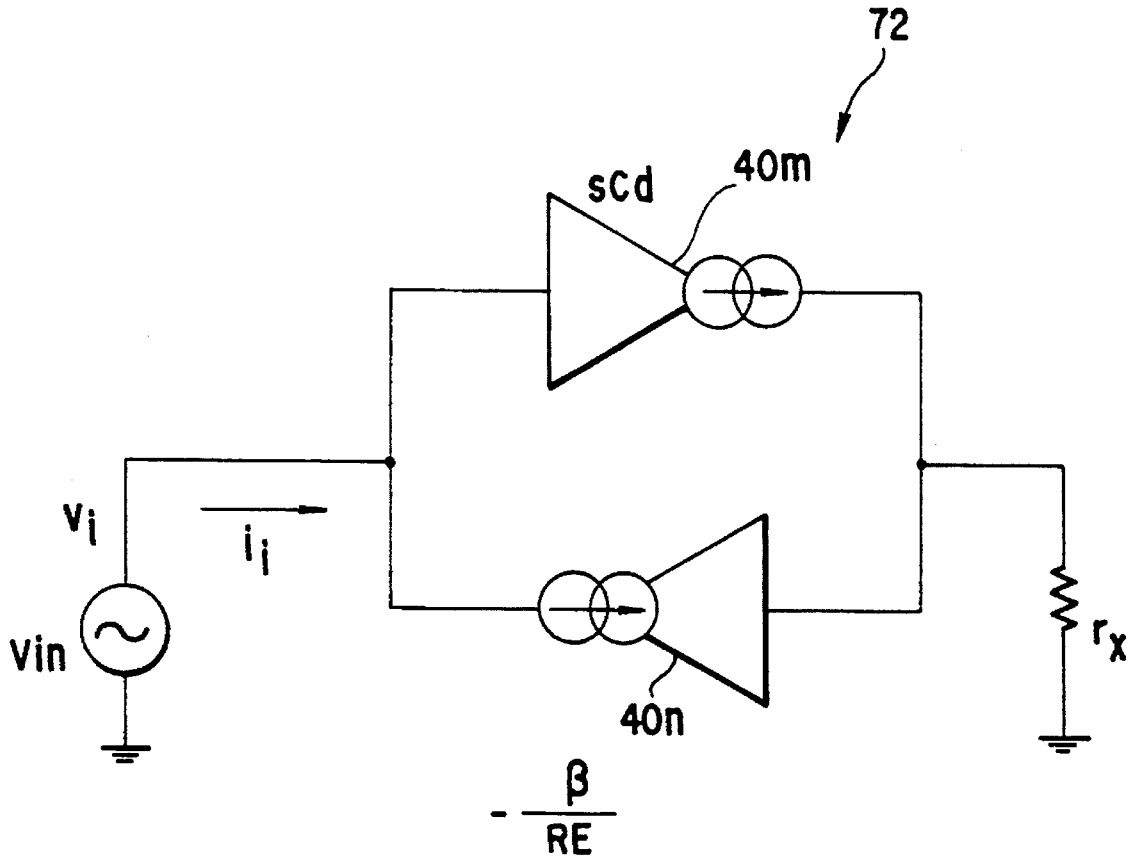
FIG. 16 is its equivalent circuit diagram.

FIG. 16 shows the equivalent circuit for explaining the operation of the impedance varying circuit 72 of FIG. 15. A current ratio (I2/I1) of the sum of currents of current sources CS1, CS2 in the upper gain cell circuit 40*m* to the current value of a current source CS9 is defined as α. The transfer function of a differentiator constituted by the gain cell circuit 40*m* is given as sCα. On the other hand, when β is used to represent a ratio (I4/I3) of the sum of currents of current sources CS1, CS2 in the lower gain cell circuit 40*n* to the current value of the current source CS9, the transfer function of the gain cell circuit 72 is given as −β/RE. Therefore, the input impedance vi/Ii obtained when viewed from the input signal voltage vin is represented by $$\begin{aligned} Vi/Ii &= re/(rx \cdot sC\alpha\beta) \\ &= (re/rx)/(sC\alpha\beta), \end{aligned} \quad (13)$$

where "re" and "rx" are resistances of the resistors RE and RX, respectively. From Equation 13, it can be said that the input impedance is given as a capacitive component. Its capacitance value is rx/rc times the capacitance of the capacitor C. The current values or current ratios α, β supplied to gain cell circuits 40*m*, 40*n* are changed to control the capacitances.

As is apparent from the above explanation, the voltage-to-current transformation characteristics of the voltage-controlled current source are changed to easily control the impedance. In this case, the gain cell circuit including the logarithmic transformation circuit of the invention can increase the transconductance gm, and simultaneously, the voltage-to-current transformation characteristics of the two voltage-controlled current sources can be independently changed. The current-ratio changeable range can thus be further expanded or widened. Note that the impedance varying circuit may alternatively be arranged by singly connecting a resistor, a variable resistive element (by means of a transistor), a capacitor, or an inductor, or that an impedance section may be constituted by a combination thereof.

Figure 17:
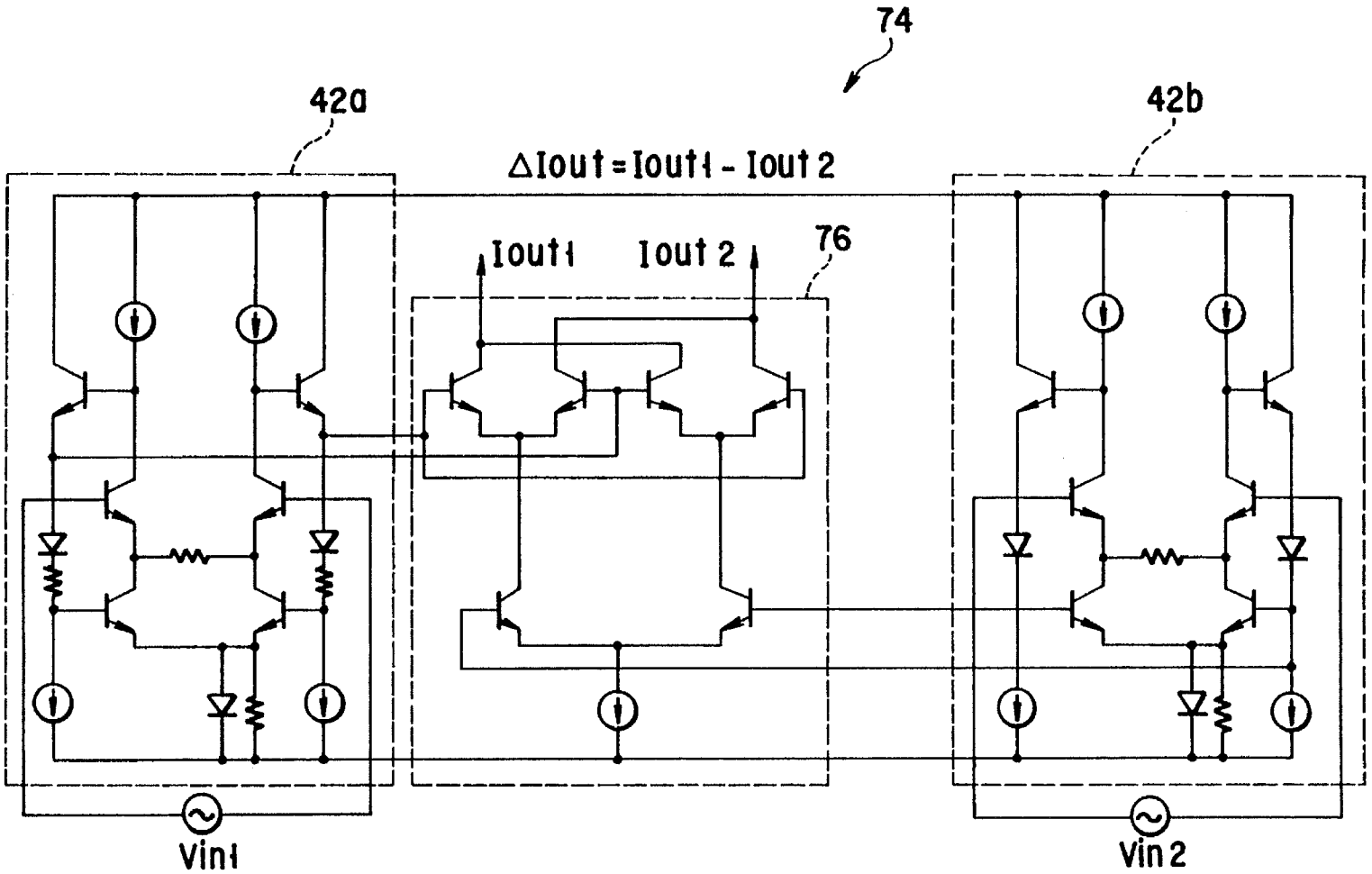
FIG. 17 is a circuit diagram of a four-quadrant multiplier constituted using the gain-cell circuit containing the logarithmic transformation circuit of the invention.

A four-quadrant multiplier 74 shown in FIG. 17 is arranged by using the logarithmic transformation circuit 42 described previously. Four-quadrant multiplier 74 includes two logarithmic transformation circuitries 42*a*, 42*b*, and a multiplier 76 having an inverse logarithmic transformation circuit function. In this case, a signal proportional to the product of the input signals vin1, Vin2 of logarithmic transformation circuitries 42*a*, 42*b* is obtained as the output from the multiplier. This multiplier can also serve as a modulator when signals being different in frequency from each other are supplied to this circuitry as the two input signals Vin1, Vin2. If the multiplier is arranged to receive signals having the same frequency as the input signals Vin1, Vin2, the multiplier may also be used as a phasedifference detector (phase comparator) for detecting a phase difference between the two input signals; the multiplier can be used as a phase comparator in a phase-locked loop (PLL), also. Furthermore, this multiplier can be used as a sync detector for detecting a modulated signal or as a mixer which is a frequency converter.

Figure 18:
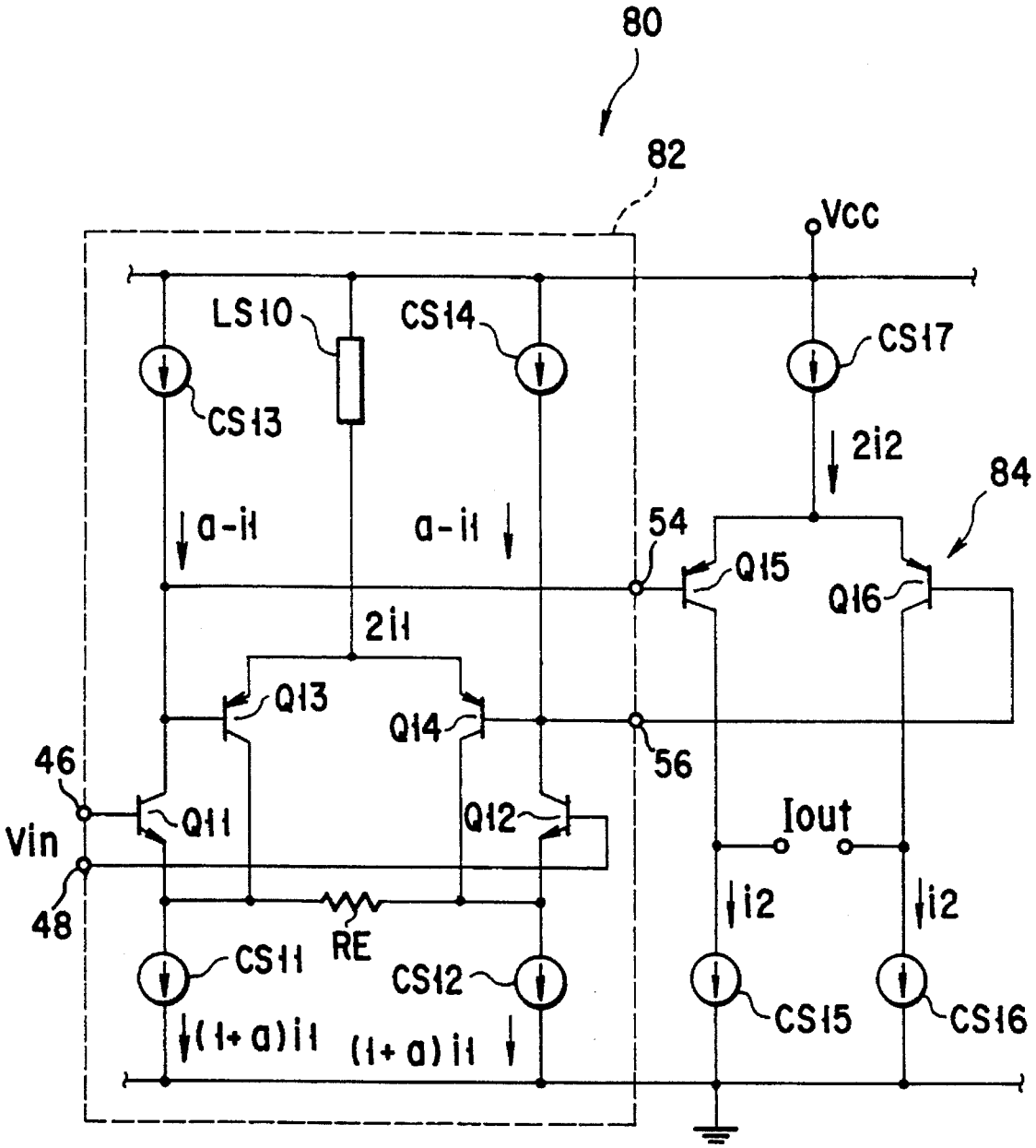
FIG. 18 is a diagram schematically showing the overall arrangement of a gain-cell circuit including a logarithmic transformation circuit in accordance with another embodiment of the invention.

A gain cell circuit 80 including a logarithmic transformation circuit in accordance with a still another embodiment of the invention is shown in FIG. 18. Gain cell circuit 80 includes a logarithmic transformation circuit 82 and an inverse logarithmic transformation circuit 84 as in the gain cell circuit 40 of FIG. 1.

In the logarithmic transformation circuit 82, NPN type bipolar transistors Q11, Q12 constitute a differential input stage for amplifying input signals. The bases of transistors Q11, Q12 are connected to input terminals 11, 12, respectively. The collectors of transistors Q11, Q12 are connected through corresponding current sources CS11, CS12 to a first power supply terminal being at a positive power supply voltage vcc. The collectors of transistors Q11, Q12 are respectively connected to the bases of PNP transistors Q13, Q14 for providing logarithmic characteristics. The collectors of transistors Q13, Q14 are connected respectively to the emitters of transistors Q11, Q12, and to both terminals of a degeneration resistor RE, respectively. The emitters of transistors Q13, Q14 are coupled to each other and are connected to the power supply voltage vcc through a common level-shift circuit LS10.

The bases of the transistors Q13, Q14 are connected to output terminals 54, 56 of the logarithmic transformation circuit 42. Output terminals 54, 56 are connected to the bases of transistors Q15, Q16 which serve as input terminals of the inverse logarithmic transformation circuit 44 arranged in the output stage of the gain cell circuit 80. Inverse logarithmic transformation circuit 44 constitutes a differential amplifier. The collectors of transistors Q15, Q16 are connected through corresponding current sources CS15, CS16 to a second power supply terminal being set at the ground potential GND. The emitters of transistors Q15, Q16 are coupled to each other and are connected to the power supply voltage Vcc through a common current source CS17. An output signal Iout of gain cell circuit 80 is taken out from the collectors of transistors Q15, Q16.

The main difference between the gain cell circuit 80 of FIG. 18 and that of FIG. 1 is that the transistors Q13, Q14 corresponding to the transistors Q3, Q4 of FIG. 1 are replaced with NPN transistors. Gain cell circuit 80 is similar to that of FIG. 1 in the basic operation and effects.

Figure 19:
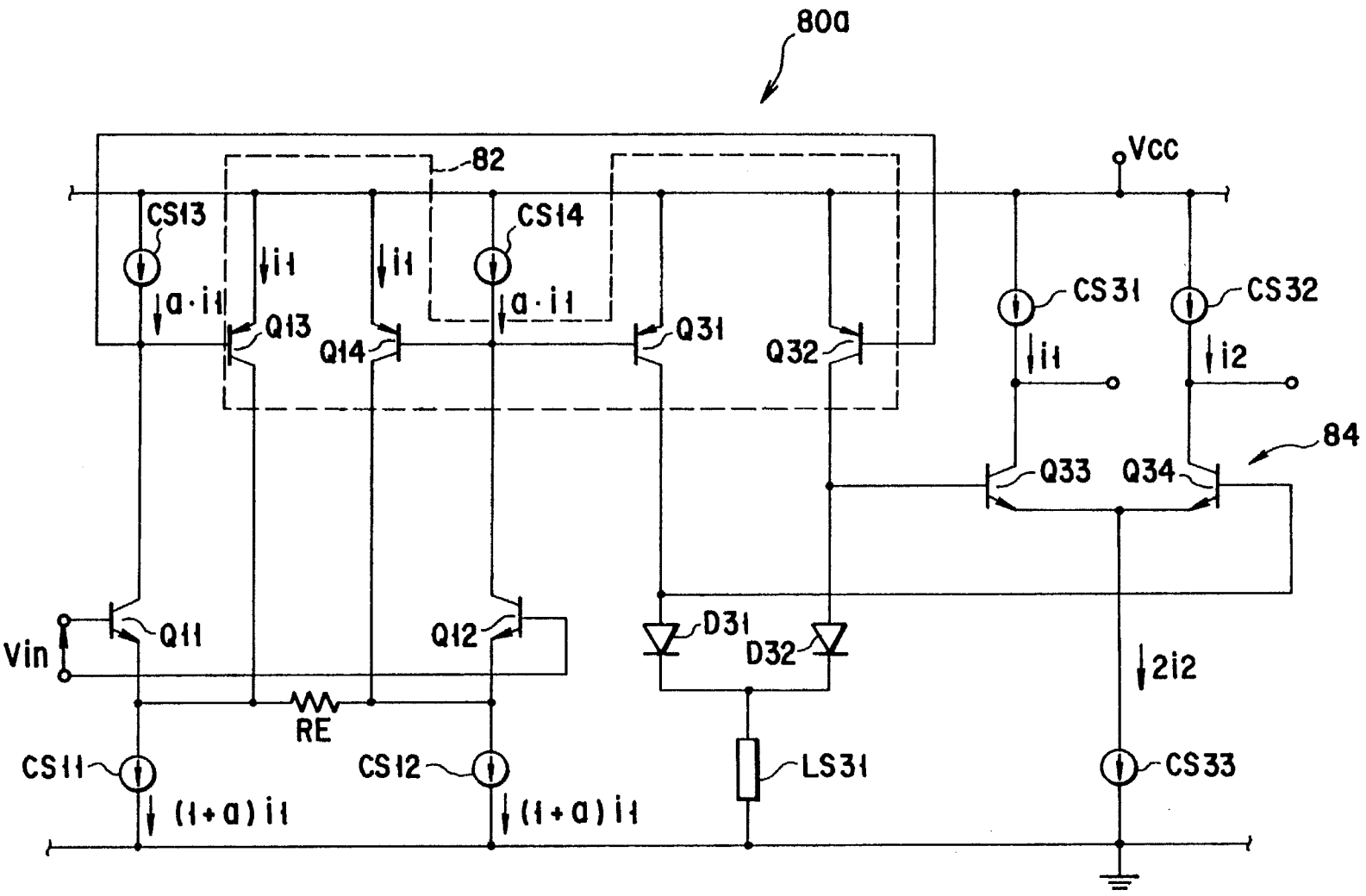
FIG. 19 is a circuit diagram of its modification.

A gain cell circuit 80*a* shown in FIG. 19 is a modification of the gain cell circuit 80 of FIG. 18. Gain cell circuit 80*a* can operate at a lower voltage as a result of the employment of a current-folding circuit. Current folding circuit 82 includes PNP transistors Q31, Q32, diodes D31, D32, and a level-shift circuit LS31. Instead of arranging the level-shift circuit LS31, the level-shift circuit LS10 is omitted in the logarithmic transformation circuit 42 of FIG. 19, and the emitters of transistors Q13, Q14 are directly coupled to the power supply voltage vcc.

The inverse logarithmic transformation circuit 84 includes transistors Q33, Q34 and current sources CS31 to CS33, which correspond to the transistor Q15, Q16 and the current sources CS15 to CS17 in FIG. 18. The bases of transistors Q33, Q34 which serve as the input terminals of inverse logarithmic transformation circuit 84 are connected to the anodes of diodes D31, D32 of current folding circuit 82.

In the current folding circuit 82, the collector currents of the transistors Q13, Q14 are equal to currents of the transistors Q31, Q32. The collector currents of transistors Q31, Q32 are transformed to voltages by the diodes D31, D32, so that the input signal voltage vin becomes a logarithmically transformed voltage. The output voltage of current folding circuit 82 is input to the bases of transistors Q15, Q16 in the inverse logarithmic transformation circuit 84 at the output stage, and therefore an output signal Iout linear to the input signal voltage vin is obtained and will be taken out externally.

In the gain cell circuit 80*a* of FIG. 19, the lower limit of the input signal voltage is vbe+vce, and the upper limit of the input signal voltage is Vcc−Vce. The voltage amplitude value vsig of an input signal which is effectively contributed to the signal amplification is defined as follows:

$$\begin{aligned} Vsig &= (Vcc - Vce) - (Vbe + Vce) \\ &= Vcc - (Vbe + 2Vce). \end{aligned} \tag{14}$$

Therefore, the minimum value of the power supply voltage required for the voltage amplitude value vsig of the input signal is represented by $$Vcc = Vsig + Vbc + 2Vcc. \tag{15}$$

This voltage is lower than the conventional value by approximately 0.3 volts.

Figure 20:
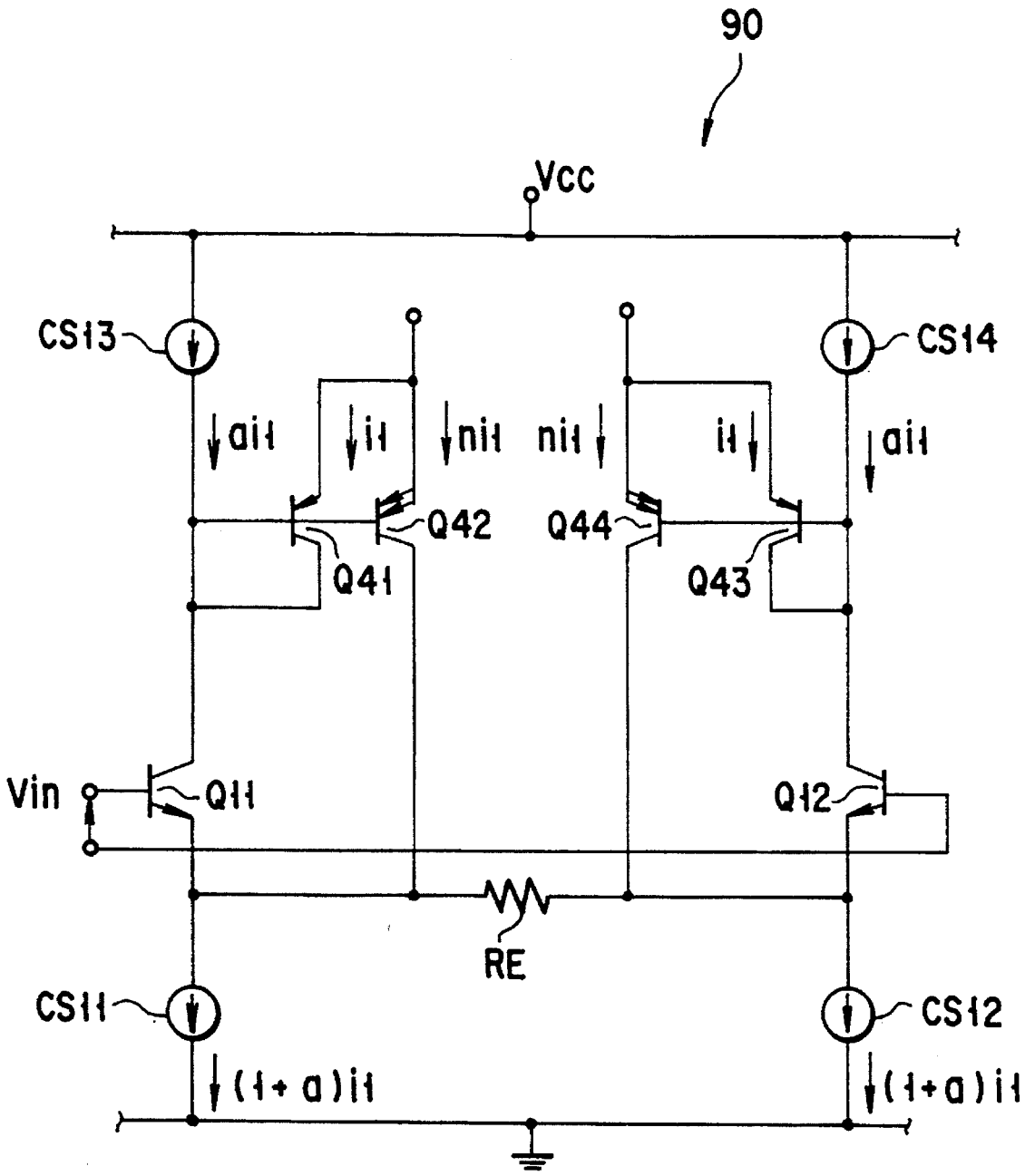
FIGS. 20, 21 and 22 are diagrams showing the circuit configurations of logarithmic transformation circuits in accordance with further embodiment of the invention.

A logarithmic transformation circuit 90 in accordance with a further embodiment of the invention is shown in FIG. 20, wherein the transistors Q13, Q14 of FIG. 18 are replaced with two current mirror circuits each having a gain. More specifically, a first current mirror circuit includes PNP type bipolar transistors Q41, Q42. Transistor Q41 is diode-connected at its base and collector, and acts as an input terminal of the current mirror circuit. The base and collector of transistor Q41 are coupled to the collector of transistor Q11. Transistor Q42 serves as an output terminal of the current mirror circuit. Transistor Q42 has a collector connected to one node of resistor RE. Similarly, a second current mirror circuit includes PNP transistors Q43, Q44. The diode-connected base and collector of transistor Q43 which serve as an input terminal of the second current mirror circuit are coupled to the collector of transistor Q12. The collector of transistor Q44 which serves as the output terminal of logarithmic transformation circuit 90 is connected to the other node of resistor RE. Each transistors Q44, Q42 has an emitter area that is n (n>1) times that of transistor Q41, Q43, so that each current mirror circuit has a current gain.

The above emitter-area increase arrangement for transistors Q44, Q42 is one of several possible techniques for providing the current mirror circuits with the gain. The provision of gain may alternatively be achieved by changing the ratio of emitter resistance of each of transistors Q41, Q42, Q43, Q44. The two methods may be combined with each other if necessary. The value of current gain itself is not so important; the gain value may be determined to fall within a certain range that is wide enough to lead to the improvement in the linearity of the voltage-to-current transformation.

Figure 21:
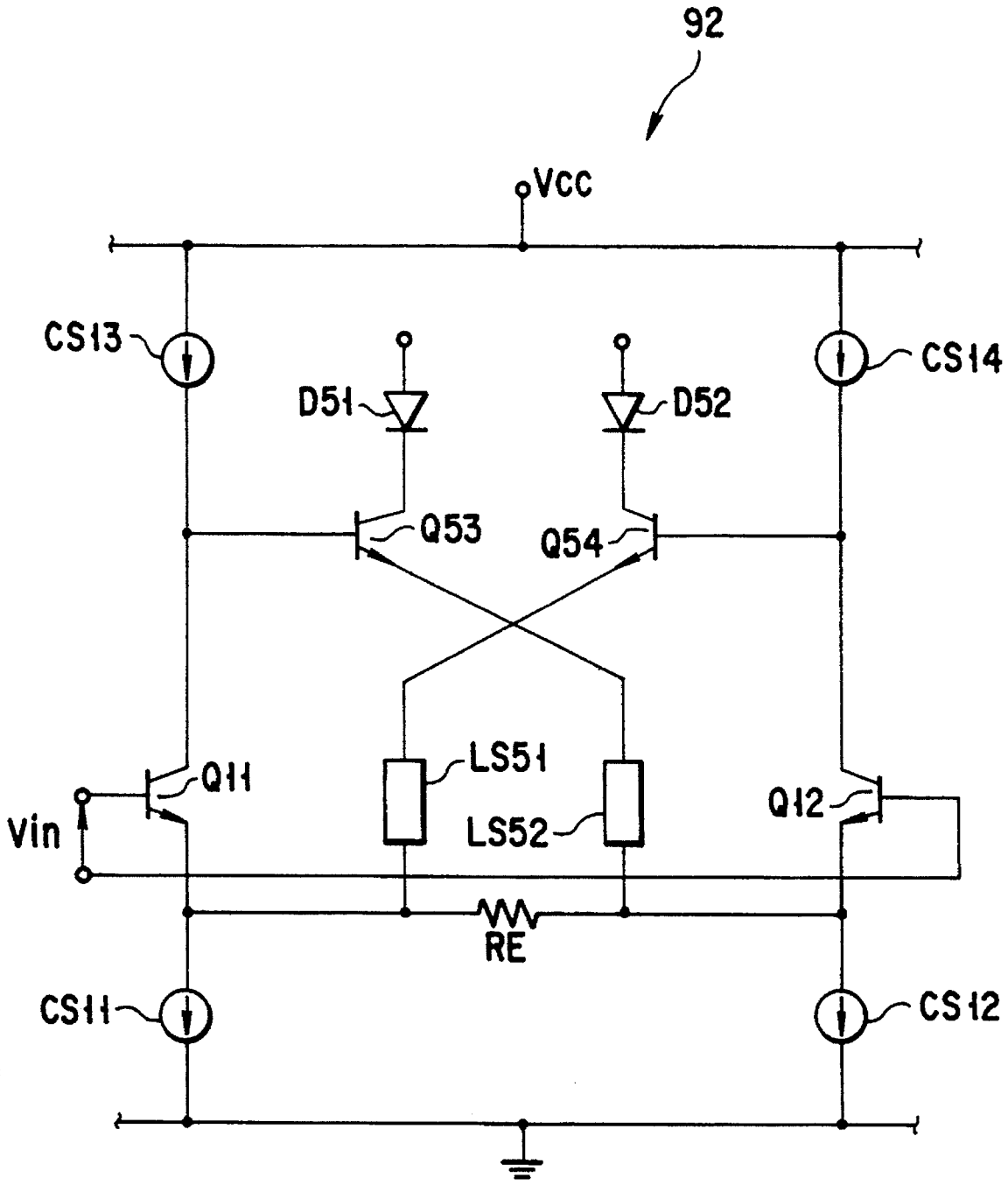

A logarithmic transformation circuit 92 in accordance with a still further embodiment of the invention is illustrated in FIG. 21, wherein current amplifying transistors Q53, Q54 are NPN type bipolar transistors, which are same in polarity (conductivity type) to the transistors Q11, Q12. More specifically, the bases of transistors Q53, Q54 are connected to the collectors of transistors Q11, Q12. The collectors of transistors Q53, Q54 are coupled to current-to-voltage transformation diodes D51, D52. The emitters of transistors Q53, Q54 are coupled to the emitters of transistors Q12, Q11 through level-shift circuits LS52, LS51, respectively. Level-shift circuits LS51, LS52 are provided to prevent the saturation of transistors Q11, Q12 when the input signal vin is larger. Instead of extracting the base- to-emitter voltages of transistors Q53, Q54, the collector currents of transistor Q51, Q52 are transformed into voltages using the diodes D51, D52. The logarithmic characteristics are attained by utilizing the fact that the forward voltages of diodes D51, D52 have a logarithmic relationship with the currents.

Figure 22:
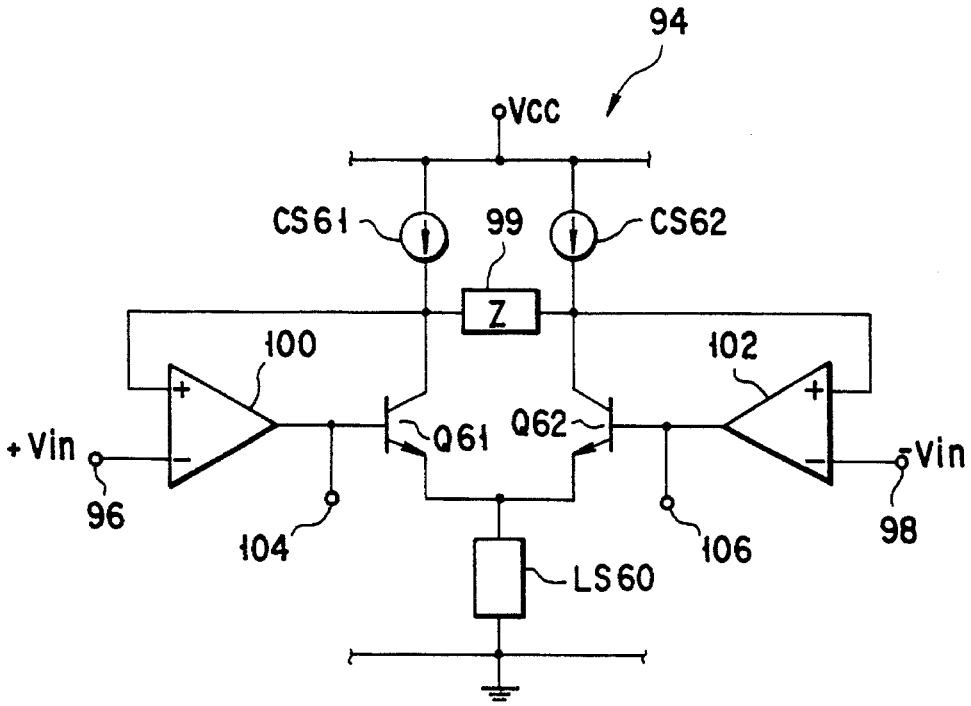

A logarithmic transformation circuit 94 shown in FIG. 22 has input terminals 96, 98, to which the inverting inputs of two-input differential amplifiers 100, 102 are connected. Differential amplifiers 100, 102 are respectively connected at their outputs to the bases of transistors Q61, Q62 for providing logarithmic characteristics. An impedance element 99 is connected between the collectors of transistors Q61, Q62. The collectors of transistors Q61, Q62 are coupled to the power supply voltage vcc through corresponding current sources CS61, CS62; the collectors of transistors Q61, Q62 are coupled to the non-inverting inputs of differential amplifiers 100, 102, thereby to attain a feedback function. The emitters of transistors Q61, Q62 are connected to each other and to the ground potential GND through a common level-shift circuit LS60. The bases (i.e., the outputs of differential amplifiers 91, 92) of the transistors Q61, Q62 are connected to output terminals 104, 106, respectively.

With the logarithmic transformation circuit 94 of FIG. 22, a feedback operation is performed, causing the non-inverting inputs of the differential amplifiers 100, 102 to be potentially equivalent to the potentials +Vin, −vin at the input terminals 96, 98. In this respect, assuming that the current sources CS61, CS62 are same in current value with each other, the following equations are established:

$$Ic62 - Ic61 = (Vin+ - Vin-)/Z, \tag{16}$$

$$Vbe61 = VT \cdot \ln(Ic61/Is),$$

$$Vbe62 = VT \cdot \ln(Ic62/Is),$$

where Ic61, Ic62 are the collector currents of transistors Q61, Q62, whereas vbe61, Vbe62 are the base-toemitter voltages of transistors Q61, Q62. VT and Is are a thermal voltage and a saturation current. As is apparent from these equations, the base-to-emitter voltage of transistor Q61, Q62 is a signal obtained by logarithmically transforming the input signal. The voltage is taken out of output terminals 104, 106 as an output signal.

Also in the embodiment 94, a high-accuracy logarithmic characteristics can be achieved, without increasing the operating current, by (1) amplifying the input signal Vin by differential amplifiers 100, 102, (2) further amplifying the same by transistors Q61, Q62 to linearize a driving current for impedance element 99. In addition, unlike the prior art described in the introductory part of the description, it will no longer happen that the base-to-emitter voltages (vbe) of the input transistors are "stacked" between the power supply voltage Vcc and the ground potential, thereby to reduce the operating voltage accordingly.

Figure 23:
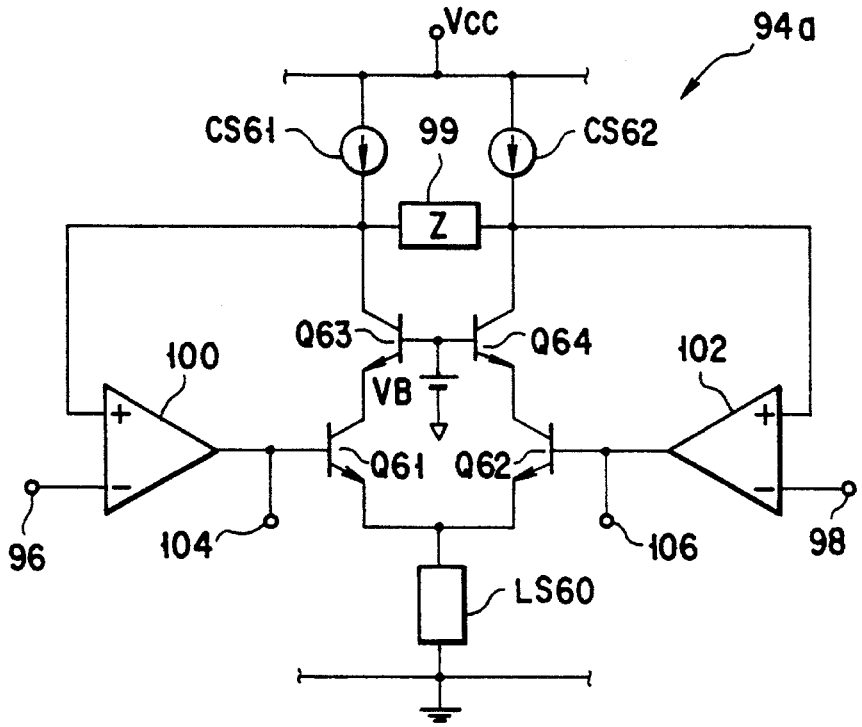
FIGS. 23 to 26 are circuit diagrams of modifications of the logarithmic transformation circuit of FIG. 22.

A logarithmic transformation circuit 94*a* shown in FIG. 23 is similar to the embodiment of FIG. 22 with base-grounded transistors Q63, Q64 being added between the transistors Q61, Q62 and the impedance element 99. Transistors Q61, Q62 have collectors coupled to the emitters of transistors Q63, Q64. The collectors of transistors Q63, Q64 are connected to the power supply voltage vcc and to both nodes of impedance element 99. Transistors Q63, Q64 are biased at their bases with an appropriate DC bias voltage VB. Outputs from the collectors of transistors Q63, Q64 are fed back to the inverting inputs of the differential amplifiers 100, 102.

Figure 24:
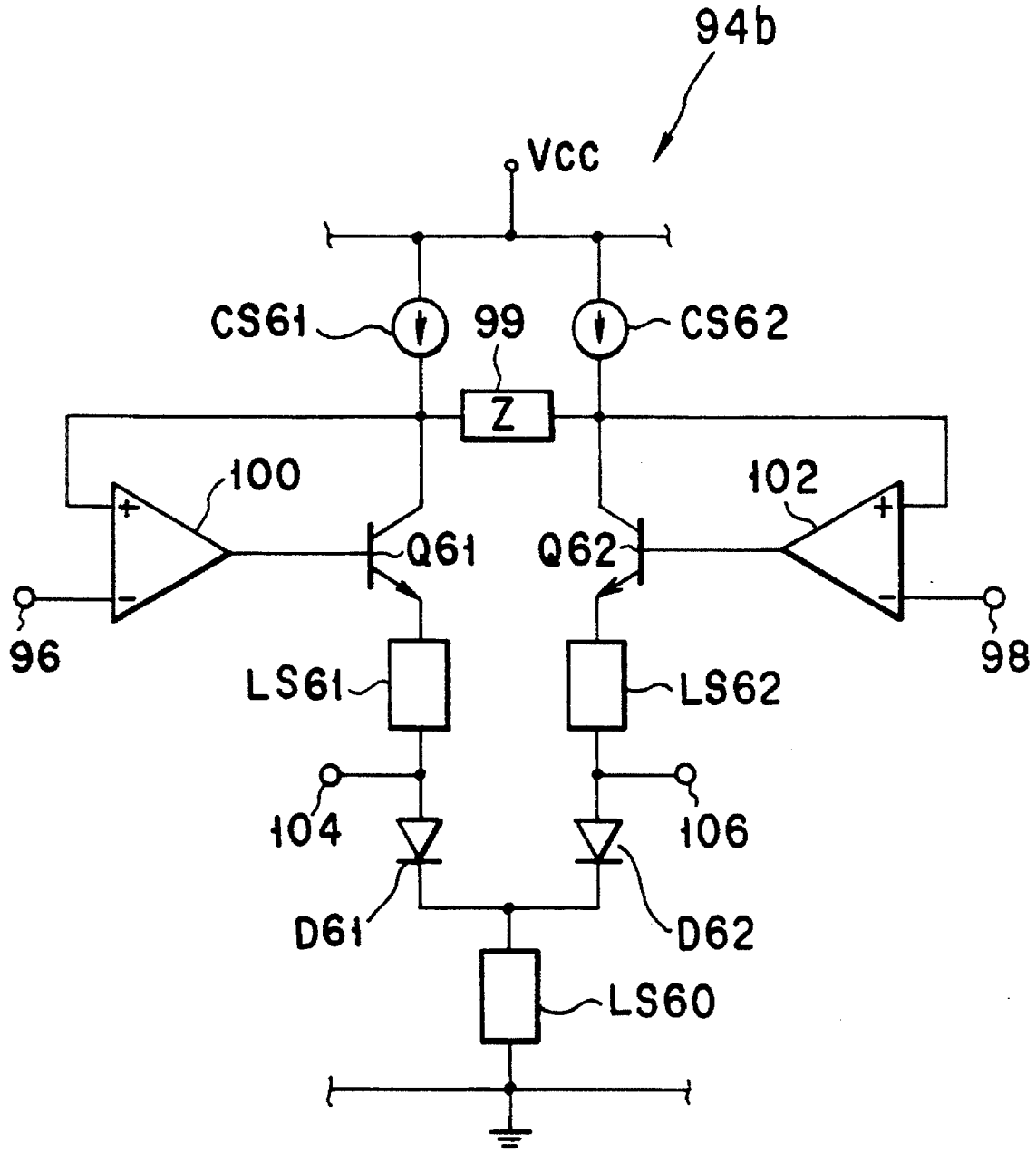

A logarithmic transformation circuit 94*b* shown in FIG. 24 is a modification of the embodiment of FIG. 22, and is different therefrom in a method of extracting the output signal. More specifically, a series circuit of a level-shift circuit LS61 and a diode D61 is connected between the emitter of transistor Q61 and the ground potential; similarly, a series circuit of a level-shift circuit LS62 and a diode D62 is connected between the emitter of the transistor Q62 and the ground potential. Connecting nodes of level-shift circuits LS61, LS62 and diodes D61, D62 are coupled to output terminals 104, 106, respectively.

With the logarithmic transformation circuit 94*b*, instead of taking out the base-to-emitter voltage of the transistors Q61, Q62, the emitter currents of transistors Q61, Q62 are transformed into voltages by the diodes D61, D62, and the input signal supplied across input terminals 11, 12 is logarithmically transformed to obtain an output signal by utilizing the fact that the forward voltages of diodes D51, D52 have a logarithmic relationship with the currents.

Figure 25:
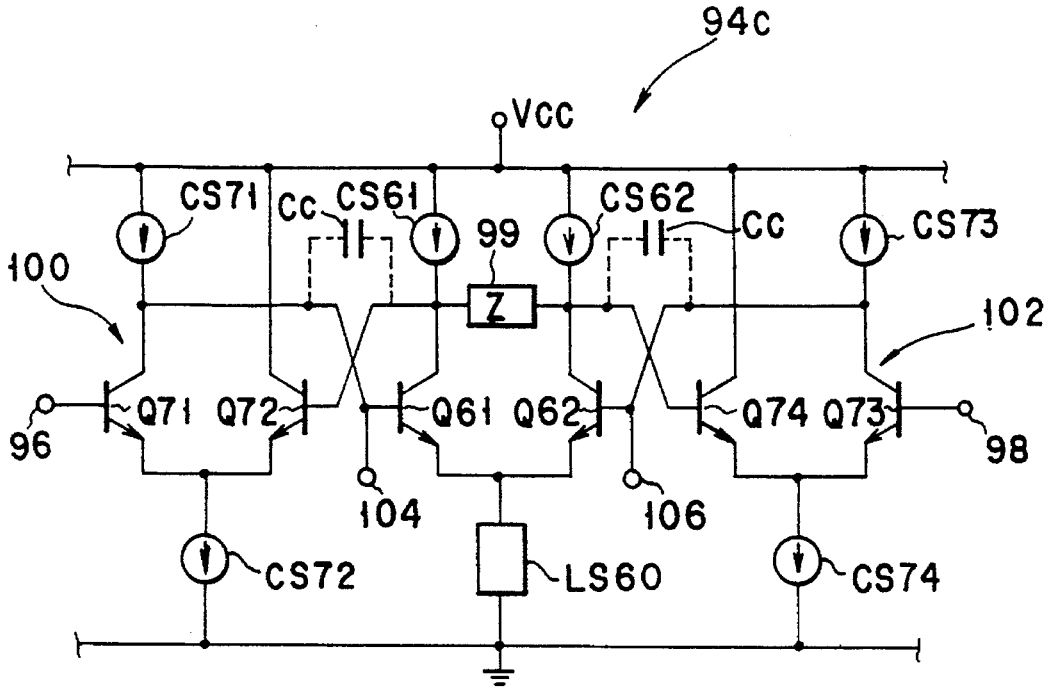

A logarithmic transformation circuit 94*c* shown in FIG. 25 has a practically designed circuit configuration based on the embodiment of FIG. 22, wherein the internal configuration of the differential amplifiers 100, 102 of FIG. 22 is illustrated in detail. Differential amplifier 100 consists of transistors Q71, Q72 having emitters connected to each other, a current source CS71 serving as a collector load of transistor Q71, and a current source CS72 coupled to the emitters of transistors Q71, Q72. Differential amplifier 102 includes transistors Q73, Q74 having emitters connected to each other, a current source CS73 acting as a collector load of transistor Q73, and a current source CS74 connected to the emitters of the transistors Q73, Q74. A capacitor Cc is a phase compensation capacitor. With such an arrangement, the intended circuitry can be constituted by making use of NPN type bipolar transistors only, which can offer a low-voltage operationability and improved frequency characteristics.

Figure 26:
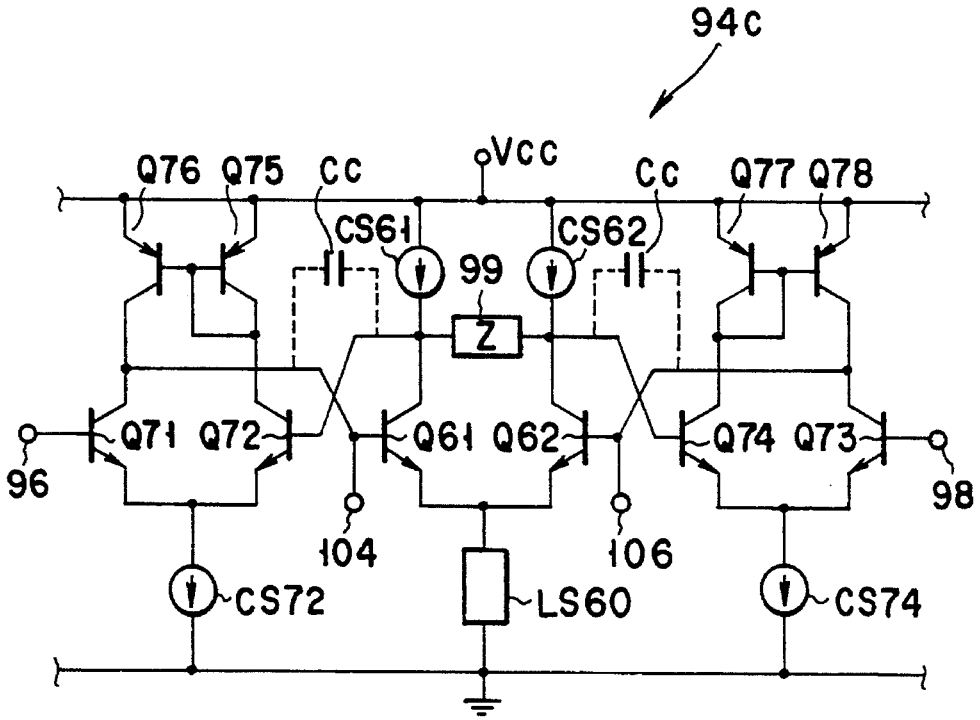

A logarithmic transformation circuit 94*c* shown in FIG. 26 is arranged such that the current sources CS71, CS73 serving as the collector loads of the transistors Q71, Q73 of FIG. 25 are replaced with current mirror circuits including transistors Q75, Q76 and transistors Q77, Q78, respectively. Also with such a modification, an intended logarithmic transformation circuit can be achieved which offers an enhanced low-voltage operationability.

Figure 27:
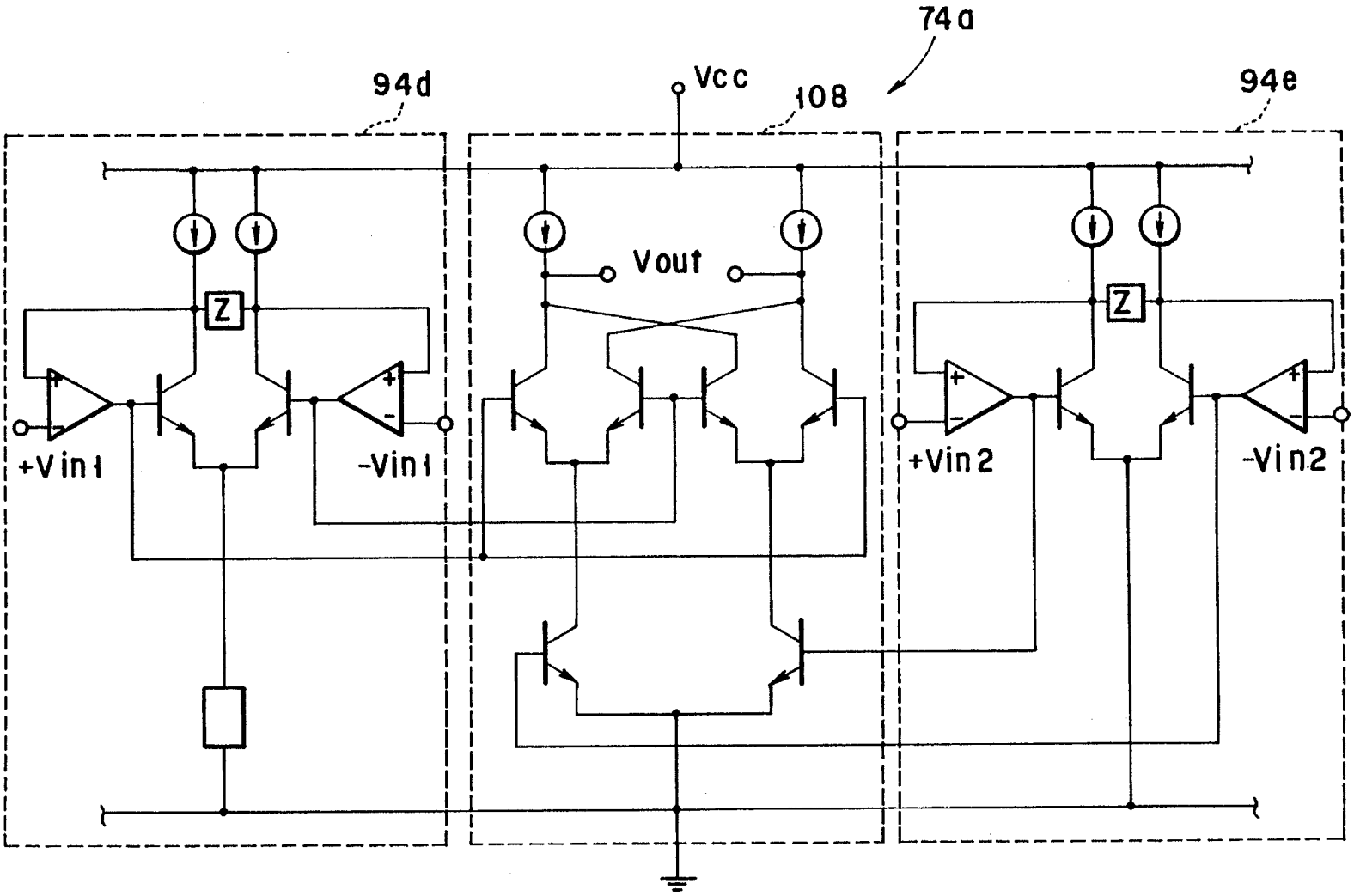
FIG. 27 is a circuit diagram of a four-quadrant multiplier constituted employing the logarithmic transformation circuit of FIG. 23.

A four-quadrant multiplier 74*a* shown in FIG. 27 is arranged using the logarithmic transformation circuit arrangement of FIG. 23. Multiplier 74*a* includes two logarithmic transformation circuitries 94*d*, 94*e*, and a multiplier 108 having an inverse logarithmic transformation circuit function. In this case, an output of the multiplier is a signal being proportional to the product of input signals Vin1 (i.e., a difference between +Vin1 and −Vin1) and Vin2(i.e., a difference between +Vin2 and −Vin2).

Figure 28:
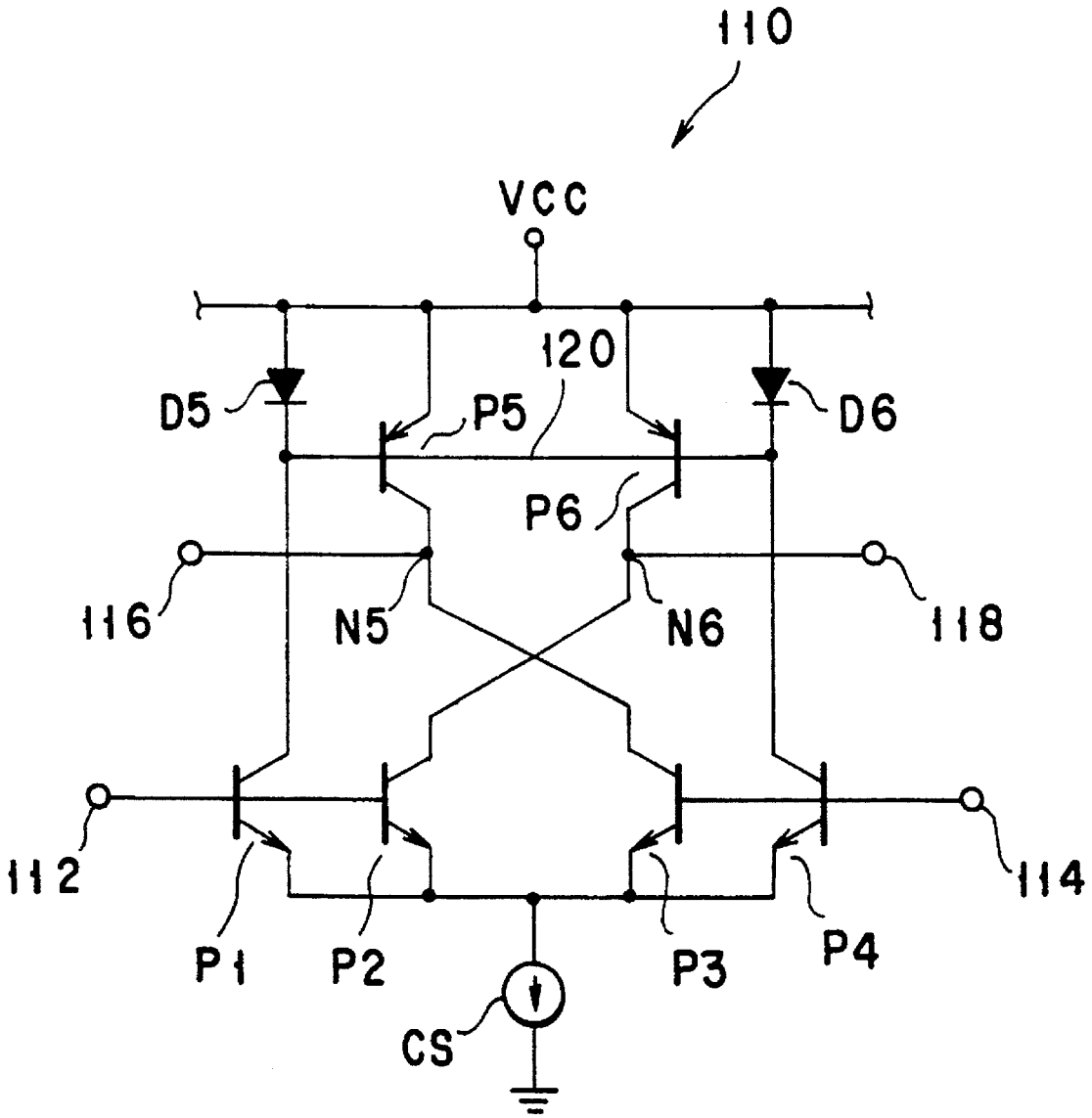
FIGS. 28 to 34 is a diagram showing a differential amplifier circuit constituting an inverse logarithmic transformation circuit which is preferably used in the gain-cell circuits in accordance with the embodiments of the invention.

An embodiment of the inverse logarithmic transformation circuit of the gain cell circuit is shown in FIG. 28, which is combined with one of the logarithmic transformation circuits 42, 42*a*, 42*b* as previously described. The inverse logarithmic transformation circuit essentially consists of a differential amplifier circuit 110. This amplifier circuit 110 can offer a specific advantage that improved frequency characteristic and high-speed operation are possible even when PNP type bipolar transistors, which remain inherently low in the cut-off frequency ft, are employed as the load of the amplifier circuit.

As shown in FIG. 28, the differential amplifier 110 includes four NPN type bipolar transistors P1, P2, P3, P4, which are commonly connected to one another at the emitters thereof. These common-connected emitters are coupled through a current source CS to the ground potential. The bases of two transistors P1, P2 are connected to an input terminal 112. The bases of the another input terminal 114. Input terminals 112, 114 may correspond to an inverting input and a non-inverting input of differential amplifier 110.

Two intermediate NPN type bipolar transistors P2, P3 have collectors, which are cross-coupled at circuit nodes N5, N6 to the collectors of the PNP type bipolar transistors P5, P6 functioning as an output load of the differential amplifier. Nodes N5, N6 are connected to output terminals 116, 118, respectively. PNP transistors P5, P6 have bases coupled by a wiring line 120 to each other. These bases are connected to the power supply voltage vcc through diodes DS, D6, respectively. The emitters of transistors P5, P6 are directly coupled to the power supply voltage vcc.

The differential amplifier 110 of FIG. 28 is supplied at input terminals 112, 114 with differential input signals being different in polarity from each other. Typically, the input signals may be the output voltage signals appearing at the terminals 54, 56 of the logarithmic transformation circuit 42 shown in FIG. 1. When the input signals are supplied, the sum of A.C. (alternate current) like output currents flowing in the collectors of NPN transistors P1, P4 remains constant. This is attained because these currents are same in absolute value as each other and yet different in polarity from each other. The base potentials of transistors P5, P6 are kept constant; therefore, the output current at the collector of each transistor is constant. This means that the signal amplification is carried out while making it unnecessary to charge the parasitic capacitance existing inherently between the base and emitter of each PNP transistor P5, P6 being low in the cut-off frequency ft. The needlessness of charging of the parasitic capacitance ensures that any degradation will not take place in the frequency characteristic of the differential amplifier, as will be explained below. The frequency characteristic of the differential amplifier is mainly determined due to NPN type bipolar transistors P1 to P4 having higher cut-off frequency. As a consequence, the upper limit of frequency whereat the amplifier can operate can be increased or "jacked up" to enter the high-frequency band. Obviously, in such a case, a resultant gain will be approximately half that of the prior art wherein the bases of PNP transistors P5, P6 are electrically separated from each other.

Figure 29:
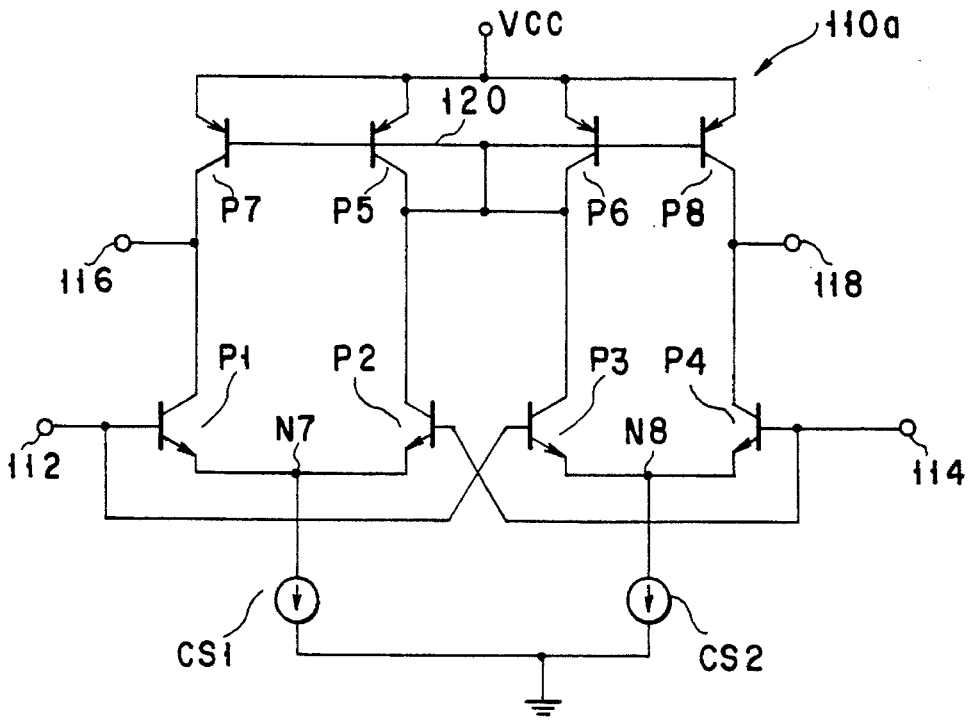

A differential amplifier 110*a* shown in FIG. 29 is similar to that of FIG. 28 with (1) the current source CS being replaced with two separate current source units CS1, CS2, and (2) the collectors of transistors P5, P6 being coupled to base interconnect line 120. Current source CS1 is connected to the emitters of transistors P1, P2 at a circuit node N7. Current source CS2 is coupled to the emitters of transistors P3, P4 at a node NS. The input terminal 112 is coupled to the bases of transistors Pl, P3, while input terminal 114 is connected to the bases of transistors P2, P4. PNP type bipolar transistors P7, P8 correspond to diodes D5, D6 of FIG. 28. With such an arrangement, the technical advantages similar to those of the embodiment shown in FIG. 28 can be accomplished.

Figure 30:
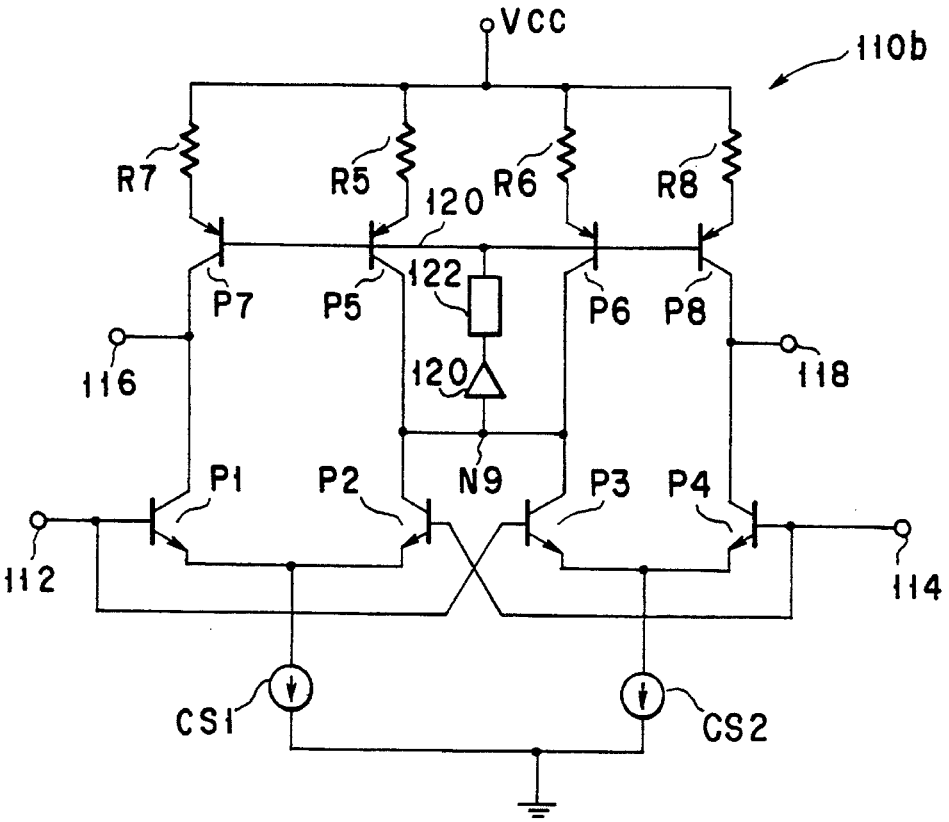

A differential amplifier 110*b* shown in FIG. 30 is similar to that of FIG. 29 with (1) resistors R5, R6, R7, R8 being inserted between the power supply voltage vcc and transistors P5 to P8, and (2) a series circuit of voltage buffer circuit 120 and a level-shift circuit 122 being the base interconnect line 120 and a circuit node N9 whereat the collectors of transistors P5, P6 are coupled together. The addition of resistors R5–R8 is directed to a decrease in the output noise and in an increase in the output resistance. voltage buffer 120 is provided to compensate for the base current of transistors P5–P8. Level-shift circuit 122 compensates for the offset in the output current due to an early voltage, by causing the collector voltage of transistors P5, P6 to be equivalent to that of transistors P7, P8.

Figure 31:
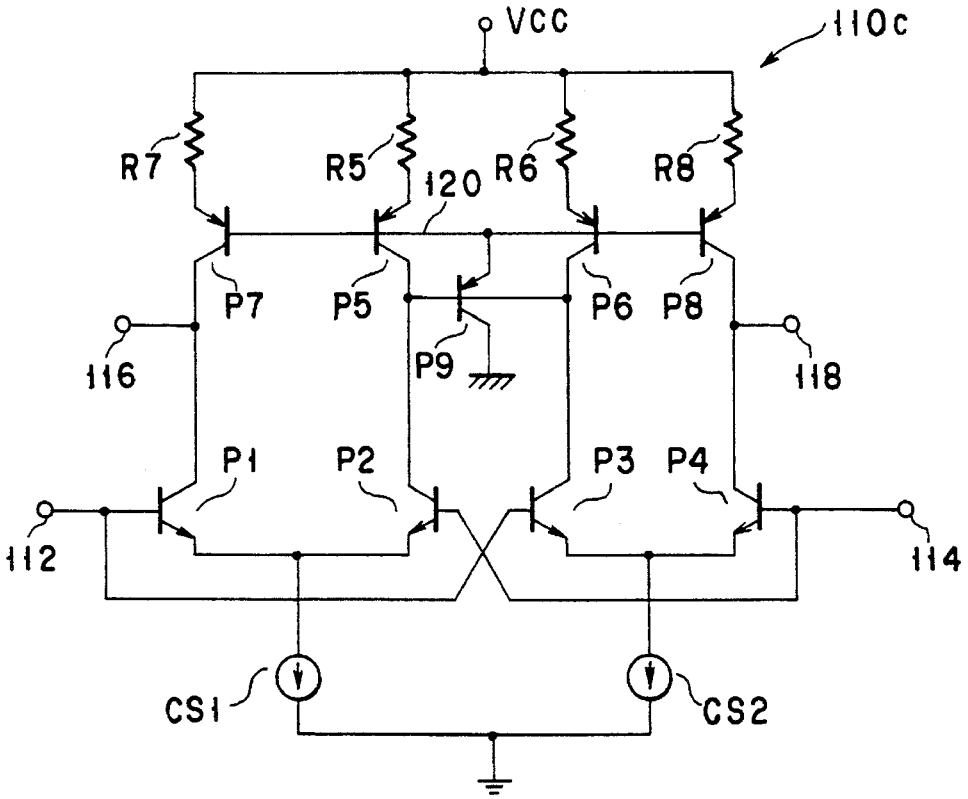

A modification 110*c* of the differential amplifier circuit 110b of FIG. 30 is shown in FIG. 31, wherein the voltage buffer circuit 120 of FIG. 30 is constituted using an emitter-follower circuitry of one PNP type bipolar transistor P9.

Figure 32:
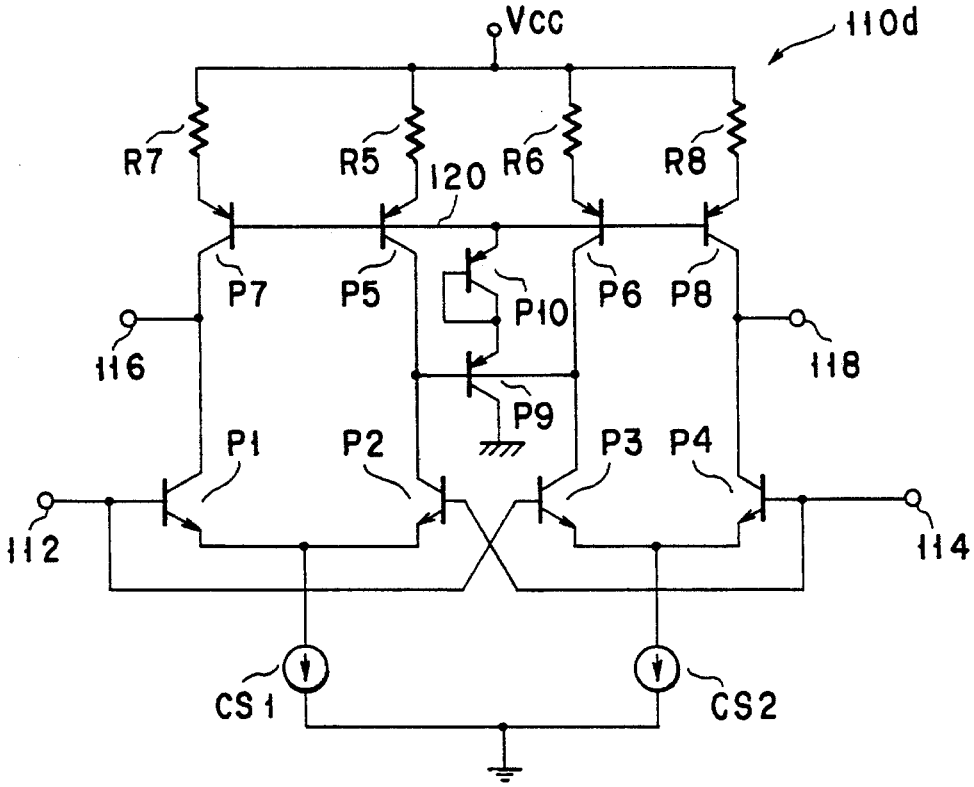

FIG. 32 shows the detailed configuration of the differential amplifier circuit 110*b* of FIG. 30. A differential amplifier 110*d* disclosed therein includes an emitter-follower circuitry of PNP type bipolar transistor P9 to constitute the voltage buffer circuit 120 of FIG. 30 in the manner as in the circuit of FIG. 31. In addition, differential amplifier 110*d* attains the level-shift circuit 122 of FIG. 30 by employing a diode-connected bipolar transistor P10.

Figure 33:
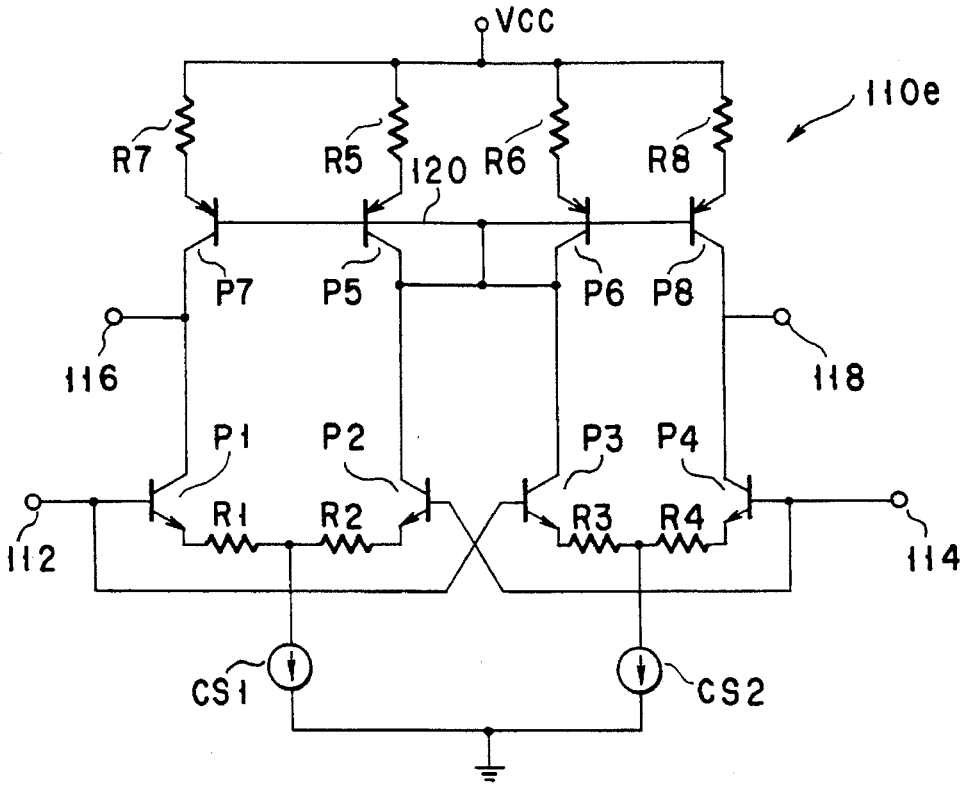
Figure 34:
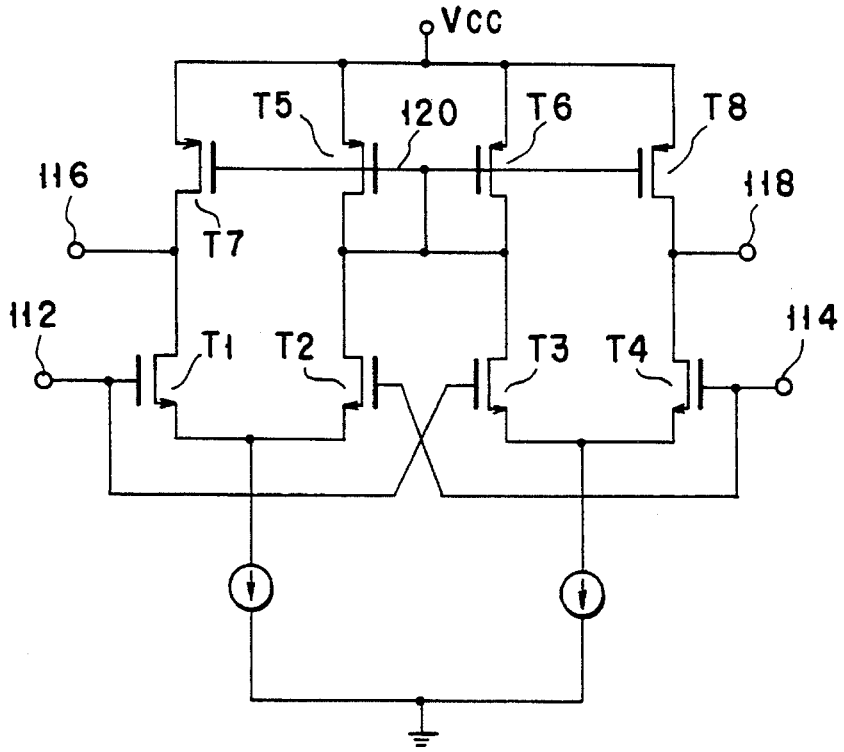

A differential amplifier circuit 110*e* shown in FIG. 33 is similar to that of FIG. 29 with emitter resistors R1 to R4 being connected to the transistors P1–P4, and with resistors R5–R8 being added between the power supply voltage Vcc and the transistors P5–PS. with such an arrangement, differential amplifier 110*e* may operate in an expanded range of voltage amplitude of input signals, thereby to expand or increase the linear operating range when the circuitry is used in a gain cell circuit.

The differential amplifier circuit 110*a* of FIG. 29 may be arranged so that the bipolar transistors are replaced with corresponding field effect transistors (FETs) T1–T8. In this case, while the transconductance for the current flow may differ, substantially the same technical advantages can be obtained as in differential amplifier 110*a* of FIG. 29.

Figure 35:
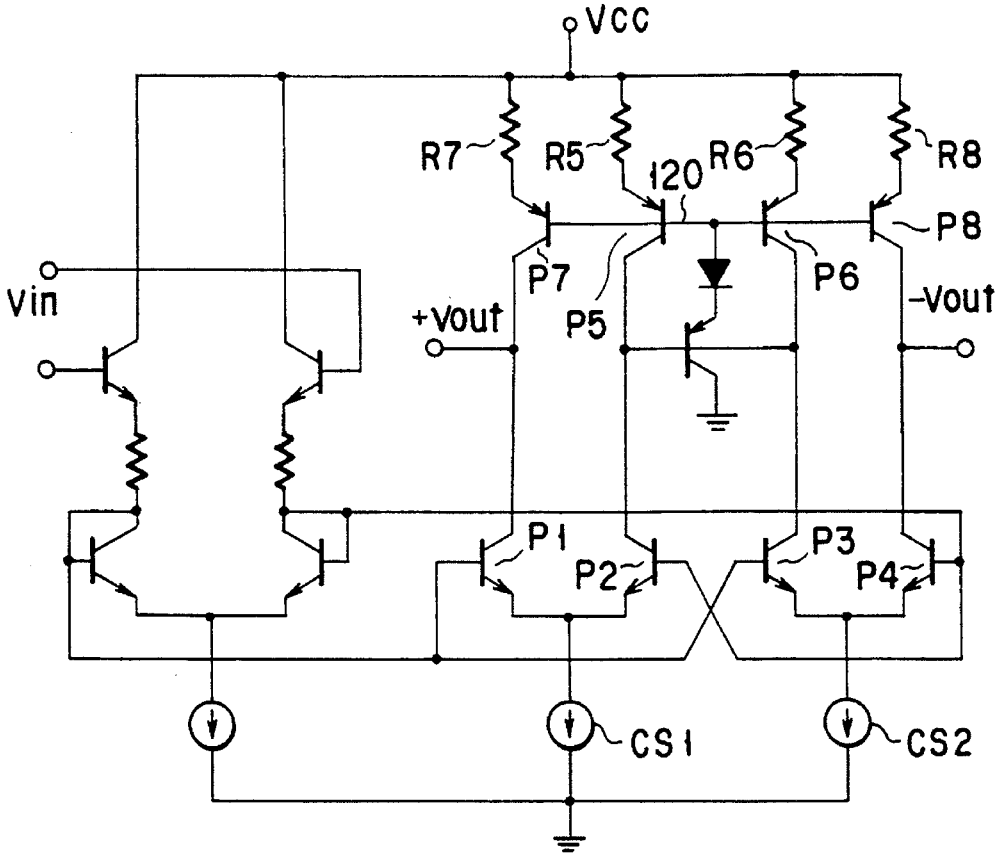
FIGS. 35 and 36 are circuit diagrams of gain-cell circuits constituted by using one of the differential amplifiers of FIGS. 28 to 34 as its inverse logarithmic transformation circuit.

An exemplary gain cell circuit is shown in FIG. 35 which uses, as its inverse logarithmic transformation circuit in the output stage thereof, a differential amplifier circuit that is similar in circuit configuration to the differential amplifier circuit 110*b* of FIG. 30. The differential amplifier of the gain cell circuit provided in the output stage of the gain cell circuit is combined with a logarithmic transformation circuit that is similar to the prior art circuit.

Figure 36:
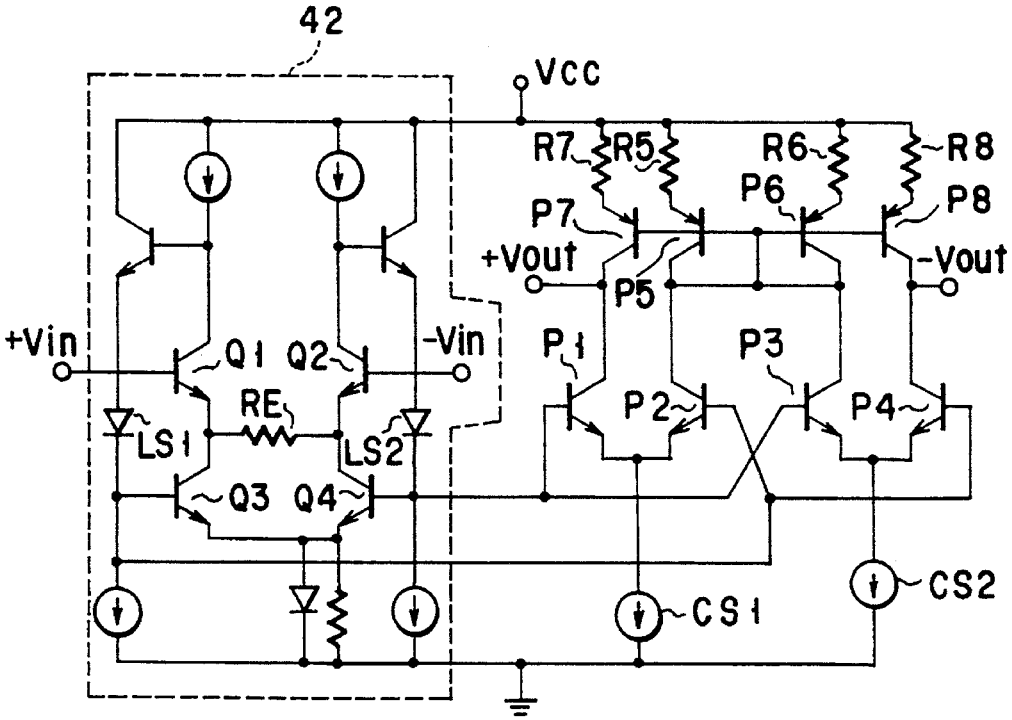

Another exemplary gain cell circuit shown in FIG. 36 employs a circuitry corresponding to the differential amplifier 110*b* of FIG. 30 as its inverse logarithmic transformation circuit provided in the output stage of the gain cell circuit. The gain cell circuit uses the basic logarithmic transformation circuit 42 of FIG. 1 in the input stage of it.

The present invention is not limited to the above-described specific embodiments and may be practiced or embodied in still other ways without departing from the spirit or essential character thereof.

What is claimed is:

1. An electronic circuit for converting input signals into output voltages at output terminals of said electronic circuit having a logarithmic relationship therewith comprising:

a pair of transistors including first and second transistors connected between a first potential and a second potential, said pair of transistors having first current-carrying electrodes connected to each other and coupled to one of the first and second potentials, second current-carrying electrodes coupled to the other of said first and second potentials, and control electrodes coupled to said output terminals of said electronic circuit in order to obtain a potential difference between a voltage from said first current-carrying electrodes to the control electrode of said first transistor and a voltage from said first current-carrying electrodes to the control electrode of said second transistor;

an impedance device having first and second nodes coupled to said second current-carrying electrodes of said transistors; and voltage generator means coupled between said second current carrying-electrodes and said output terminal of said electronics circuit for receiving said input signals externally supplied thereto, and for causing a certain voltage indicative of a potential difference between the input signals to be generated at said first and second nodes of said impedance device, output terminals of said voltage generator means being respectively connected to the control electrodes of said pair of transistors.

2. The circuit according to claim 1, wherein said voltage generator means comprising a pair of first and second differential amplifier means for receiving said input signal and for amplifying the input signal.

3. The circuit according to claim 2, further comprising:

a level shift circuit provided between said first current-carrying electrodes of said pair of transistors and said one of the first and second potentials.

4. The circuit according to claim 2, wherein each of said first and second differential amplifier means comprises pairs of differential transistors.

5. A logarithmic transformation circuit comprising:

a pair of first and second differential amplifier means for receiving a differential input signal and for amplifying the differential input signal, said first and second differential amplifier means each having a first input respectively coupled to the differential input signal, and a second input and an output;

an impedance element, having first and second nodes, respectively connected to the second input of said first and second differential amplifier means at said first and second nodes;

a pair of transistors including first and second transistors associated with said first and second differential amplifier means, having control electrodes respectively coupled to the output of said first and second differential amplifier means and output terminals of said logarithmic transformation circuit so as to obtain a potential difference between a voltage from said first current-carrying electrodes to the control electrode of said first transistor and a voltage from said first current-carrying electrodes to the control electrode of said second transistor, wherein said first current carrying electrodes connected to each other and said coupled to a ground potential, and second current carrying electrodes respectively connecting the first and second nodes to the second inputs of said first and second differential amplifier means and coupled to a power supply; and a level-shift circuit provided between said first current carrying electrodes of said pair of transistors and said ground potential.

6. The circuit according to claim 5, further comprising:

another pair of transistors connected between said second current carrying electrodes of said pair of transistors and said first and second nodes, said another pair of transistors having control electrodes being DC-biased.

7. The circuit according to claim 5, wherein said impedance element includes a resistance element.

8. The circuit according to claim 5, wherein said first inputs of said differential amplifier means are inverting inputs and said second inputs of said differential amplifier means are non-inverting inputs.

9. The circuit according to claim 5, wherein said differential amplifier means comprises pairs of differential transistors, wherein loads of said differential transistors are coupled between current carrying electrodes of said differential transistors and one of the first and second potentials.

10. The circuit according to claim 9, wherein loads of said differential transistors are current sources.

11. The circuit according to claim 9, wherein loads of said differential transistors are current mirror circuits.

12. A logarithmic transformation circuit comprising:

a pair of first and second differential amplifier means for receiving a differential input signal and for amplifying the differential input signal, said first and second differential amplifier means each having a first input respectively coupled to the differential input signal, a second input and an output;

an impedance element connected to the second inputs of said first and second differential amplifier means;

a pair of transistors including first and second transistors associated with said first and second differential amplifier means, having control electrodes respectively coupled to the output of said first and second differential amplifier means, first current carrying electrodes coupled to a ground potential, and second current carrying electrodes respectively connecting the first and second node to the second inputs of said first and second differential amplifier means and coupled to a power supply means; and level-shift circuits provided between said first current carrying electrodes of said pair of transistors and output terminals of said logarithmic transformation circuit, wherein said output terminals are taken between said level-shift circuit and ground potential.

* * * * *